US008771497B2

(12) United States Patent
Maekawa et al.

(10) Patent No.: US 8,771,497 B2
(45) Date of Patent: Jul. 8, 2014

(54) ELECTROLYZER, ELECTRODES USED THEREFOR, AND ELECTROLYSIS METHOD

(75) Inventors: Hiroshi Maekawa, Sodegaura (JP); Mitsuru Sadamoto, Sodegaura (JP); Souta Itou, Ichihara (JP); Shin Fukuda, Sodegaura (JP); Kentaro Suzuki, Musashino (JP); Tetsuya Watanabe, Musashino (JP); Katsumi Isozaki, Musashino (JP)

(73) Assignee: Mitsui Chemicals, Inc., Minato-Ku, Tokyo (JP)

( * ) Notice: Subject to any disclaimer, the term of this patent is extended or adjusted under 35 U.S.C. 154(b) by 1235 days.

(21) Appl. No.: 12/596,767

(22) PCT Filed: Apr. 17, 2008

(86) PCT No.: PCT/JP2008/001012

§ 371 (c)(1),
(2), (4) Date: Jan. 6, 2010

(87) PCT Pub. No.: WO2008/132818

PCT Pub. Date: Nov. 6, 2008

(65) Prior Publication Data

US 2010/0126875 A1 May 27, 2010

(30) Foreign Application Priority Data

Apr. 20, 2007 (JP) ..... 2007-111648

(51) Int. Cl.

| | |
|---|---|
| ***C25B 1/24*** | (2006.01) |
| ***C25B 9/06*** | (2006.01) |
| *C25B 11/03* | (2006.01) |

(52) U.S. Cl.

USPC ..... 205/359; 204/247; 204/278; 205/354; 205/619

(58) Field of Classification Search

USPC ..... 205/619, 359; 204/278

See application file for complete search history.

(56) References Cited

U.S. PATENT DOCUMENTS

| | | | | |
|---|---|---|---|---|
| 2,396,171 | A * | 3/1946 | Gardiner | 205/404 |
| 3,274,082 | A * | 9/1966 | Szechtman | 205/411 |

(Continued)

FOREIGN PATENT DOCUMENTS

| | | |
|---|---|---|
| JP | 57-200584 A | 12/1982 |
| JP | 57-200585 A | 12/1982 |

(Continued)

OTHER PUBLICATIONS

International Search Report (PCT/ISA/210) dated May 16, 2008.

*Primary Examiner* — Bryan D. Ripa

(74) *Attorney, Agent, or Firm* — Buchanan, Ingersoll & Rooney, PC

(57) ABSTRACT

An electrolyzer is comprised of an anode and a cathode which are in contact with an electrolytic solution, wherein at least one of the anode and the cathode is composed of an electric conductor having a gas permeable structure comprising a gas generating surface at which gas is generated by electrolysis of the electrolytic solution, a plurality of through holes leading from the gas generating surface to a different surface and allowing the gas generated on the gas generating surface to selectively pass therethrough, and a gas releasing surface which is the different surface for releasing the gas supplied from the gas generating surface via the through holes. At least one of a surface treatment which causes the gas generating surface to be lyophilic for the electrolytic solution and a surface treatment which causes the gas releasing surface to be lyophobic for the electrolytic solution is performed.

15 Claims, 17 Drawing Sheets

(56) References Cited

U.S. PATENT DOCUMENTS

| | | | | |
|---|---|---|---|---|
| 3,562,135 | A * | 2/1971 | Marincek | 204/247 |
| 4,086,155 | A * | 4/1978 | Jonville | 204/266 |
| 4,260,469 | A * | 4/1981 | McIntyre et al. | 204/265 |
| 4,956,068 | A * | 9/1990 | Nguyen et al. | 205/350 |
| 5,538,585 | A * | 7/1996 | Wakita et al. | 156/308.2 |
| 5,589,044 | A * | 12/1996 | Scannell et al. | 204/286.1 |
| 5,618,392 | A * | 4/1997 | Furuya | 204/252 |
| 2004/0055874 | A1* | 3/2004 | Hiraiwa et al. | 204/250 |
| 2007/0045104 | A1* | 3/2007 | Wang et al. | 204/206 |
| 2007/0175767 | A1* | 8/2007 | Suzuki | 205/703 |
| 2009/0032405 | A1* | 2/2009 | Ono et al. | 205/348 |

FOREIGN PATENT DOCUMENTS

| | | | |
|---|---|---|---|
| JP | 2002-339090 | A | 11/2002 |
| JP | 2005-270732 | A | 10/2005 |
| JP | 2006-291297 | A | 10/2006 |

* cited by examiner (a)

(b)

(a)

(b)

(a)

(b)

(a)

(b)

ELECTROLYZER, ELECTRODES USED THEREFOR, AND ELECTROLYSIS METHOD

TECHNICAL FIELD

The present invention relates to an electrolyzer for electrolyzing an electrolytic solution, an electrode used for the electrolyzer, and an electrolysis method.

BACKGROUND ART

A fluorine gas having a low warming potential has been paid attention to as a gas for cleaning semiconductor manufacturing devices or the like. However, there are problems such that the fluorine gas is highly explosive, a gas cylinder cannot be filled with high pressure, and further the transportation cost is incurred because of such properties. Accordingly, there has been developed a fluorine gas generating device capable of supplying a fluorine gas at the place of using it (for example, refer to Patent Document 1).

In Patent Document 1, there has been disclosed a fluorine gas generating device equipped with an electrolytic bath separated into an anode chamber and a cathode chamber by a partition, and a pressure-maintaining means for supplying gases respectively to the aforementioned anode chamber and the cathode chamber, and maintaining the inside of the anode chamber and the cathode chamber at a predetermined pressure. Patent Document 1 discloses that, according to such a fluorine gas generating device, it is possible to generate a high purity fluorine gas by electrolyzing mixed molten salt containing hydrogen fluoride.

Patent Document 1: Japanese Patent Laid-open No. 2002-339090

DISCLOSURE OF THE INVENTION

However, when the treatment of a gas generated in a step of electrolyzing an electrolytic solution is inappropriate, an insulating compound is formed on a surface of an electrode together with a component in the electrolytic solution. When electrolysis is continuously carried out in a state that such an insulating compound covering the surface of the electrode is not treated, electrolysis has been stopped in some cases. Details are as follows.

1) The gas generated by electrolysis is attached to the electrode surface over a long period of time without being removed from the electrode surface.

2) The current is induced in the electrode to which a voltage is applied, and the gas forms an insulating compound on the electrode surface by electrochemical action with the gas generated by electrolysis.

3) The electrode surface with bubbles attached thereto is not brought into contact with the electrolytic solution so that the current does not flow and fails to contribute to electrolysis. On the other hand, on the electrode surface with no bubbles attached thereto, the current density is relatively increased. In this way, on the same electrode surface, the current density becomes non-uniform and the desired gases cannot be generated with good efficiency. In particular, when an electrolyzer is driven, an insulating compound is formed on the electrode surface with bubbles attached thereto in some cases. As a result, the non-uniformity in the current density on the electrode surface has been increased in some cases.

4) Since the electrode surface is influenced by the generated gas as described above, the degree of freedom in design of the electrode structure and electrolytic bath has been restricted.

The present invention is carried out in view of the aforementioned situations and its object is to provide an electrolyzer capable of generating desired gases with good efficiency by improving the efficiency of electrolysis, an electrode used for the electrolyzer, and an electrolysis method.

The present invention is provided with the following configurations:

(1) an electrolyzer comprising an anode and a cathode in contact with an electrolytic solution, wherein at least one of the anode and the cathode is composed of an electric conductor having a gas permeable structure comprising a gas generating surface at which a gas is generated by electrolysis of the electrolytic solution, a plurality of through holes leading from the gas generating surface to a different surface and allowing the gas generated at the gas generating surface to selectively pass therethrough, and a gas releasing surface which is the different surface for releasing the gas supplied from the gas generating surface via the through holes, and at least one of a surface treatment which causes the gas generating surface to be lyophilic for the electrolytic solution and a surface treatment which causes the gas releasing surface to be lyophobic for the electrolytic solution is performed;

(2) the electrolyzer as set forth in (1), wherein a storage tank is filled with the electrolytic solution;

(3) the electrolyzer as set forth in (1) or (2), wherein the anode and the cathode are arranged in parallel and the respective gas generating surfaces are oppositely disposed to each other;

(4) the electrolyzer as set forth in any one of (1) to (3), wherein at least one of the anode and the cathode is immersed in the direction perpendicular to the liquid surface of the electrolytic solution;

(5) the electrolyzer as set forth in any one of (1) to (4), wherein the electrolyzer is provided with a gas storage unit for covering the gas releasing surface of at least one of the anode and the cathode, and receiving the gas released from the gas releasing surface;

(6) the electrolyzer as set forth in (5), wherein at least two pairs of the anodes and the cathodes are provided, at least the gas releasing surfaces of the anodes or the gas releasing surfaces of the cathodes are oppositely disposed to each other, and the gas storage unit for covering any of a pair of the gas releasing surfaces facing to each other is provided;

(7) the electrolyzer as set forth in (5) or (6), wherein the gas storage unit is provided with an inert gas supply unit, and is configured such that it can be ventilated by supplying the inert gas from the inert gas supply unit to the inside of the gas storage unit;

(8) the electrolyzer as set forth in (5) or (6), wherein the gas storage unit of the anode or the cathode is provided with a raw material gas supply unit, and is configured such that the raw material gas supplied from the raw material gas supply unit can be supplied to the electrolytic solution via the through holes;

(9) the electrolyzer as set forth in any one of (1) to (4), wherein at least one of the anode and the cathode is horizontally arranged to the liquid surface of the electrolytic solution and only the gas generating surface is brought into contact with the liquid surface of the electrolytic solution;

(10) the electrolyzer as set forth in (9), wherein at least one of the anode and the cathode horizontally arranged to the liquid surface of the electrolytic solution is configured so as to able to move vertically;

(11) the electrolyzer as set forth in any one of (2) to (10), wherein the storage tank is provided with a raw material gas supply unit and is configured such that the raw material gas can be supplied to the electrolytic solution from the raw material gas supply unit;

(12) the electrolyzer as set forth in any one of (1) to (11), wherein the electrolyzer is provided with an ultrasonic wave generation means for applying an ultrasonic wave to at least one of the anode or the cathode;

(13) the electrolyzer as set forth in any one of (1) to (12), wherein the electrode having a gas permeable structure is used for the electrode for generating the gas when the gas generated on the gas generating surface of the anode or the gas generating surface of the cathode prevents electrolysis of the electrolytic solution;

(14) the electrolyzer as set forth in any one of (1) to (13), wherein the surface treatment for imparting the lyophilic property is plasma treatment, ozone treatment or corona discharge treatment, and the surface treatment for imparting the lyophobic property is fluorine resin coating treatment, plasma treatment using a fluorine gas or fluorine gas treatment;

(15) the electrolyzer as set forth in any one of (1) to (14), wherein at least one of the anode and the cathode has a gas permeable structure selected from a mesh structure, a porous structure, a porous film structure, and a structure with a plurality of the through holes arranged in the thickness direction of the electric conductor in a film shape or in a plate shape;

(16) an electrolyzer comprising an electrode in contact with an electrolytic solution, wherein the electrode is composed of a plurality of strip-shaped electrodes arranged by spacing at almost equal intervals from one another, and a DC voltage is applied between electrodes located at both ends among a plurality of the strip-shaped electrodes;

(17) the electrolyzer as set forth in any one of (1) to (15), wherein the electrolytic solution is molten salt containing hydrogen fluoride and a fluorine gas is generated at the anode;

(18) the electrolyzer as set forth in any one of (8), (11) to (15), wherein the raw material gas contains hydrogen fluoride;

(19) an electrode comprising an electric conductor having a gas permeable structure equipped with a gas generating surface at which a gas is generated by electrolysis of the electrolytic solution, a plurality of through holes leading from the gas generating surface to a different surface and a gas releasing surface which is the different surface for releasing the gas supplied from the gas generating surface via the through holes, wherein at least one of a surface treatment which causes the gas generating surface to be lyophilic for the electrolytic solution and a surface treatment which causes the gas releasing surface to be lyophobic for the electrolytic solution is performed;

(20) an electrolysis method using the electrolyzer as set forth in any one of (1) to (18); and

(21) an electrolyzer including an electrode used for at least any one of an anode or a cathode, wherein the electrode is composed of a conductor having a gas permeable structure allowing only a gas to pass by performing any one or both of a surface treatment which causes a surface desired to be wetted by the electrolytic solution to be lyophilic or a surface treatment which causes a reverse surface desired not to be wetted by the electrolytic solution to be lyophobic on an electric conductor having a plurality of through holes leading from an arbitrary surface to a reverse surface.

According to the electrolyzer of the present invention, attachment of bubbles to the electrode surface and accordingly generation of an insulating compound are suppressed, whereby the current density per unit area of the electrode becomes uniform over a long period of time. Therefore, it is possible to obtain desired gases effectively by electrolysis. Furthermore, an effect of the generated gas on the electrode surface is suppressed so that the degree of freedom in the design of the electrode structure and the electrolytic bath is improved.

BEST MODE FOR CARRYING OUT THE INVENTION

Figure 1:
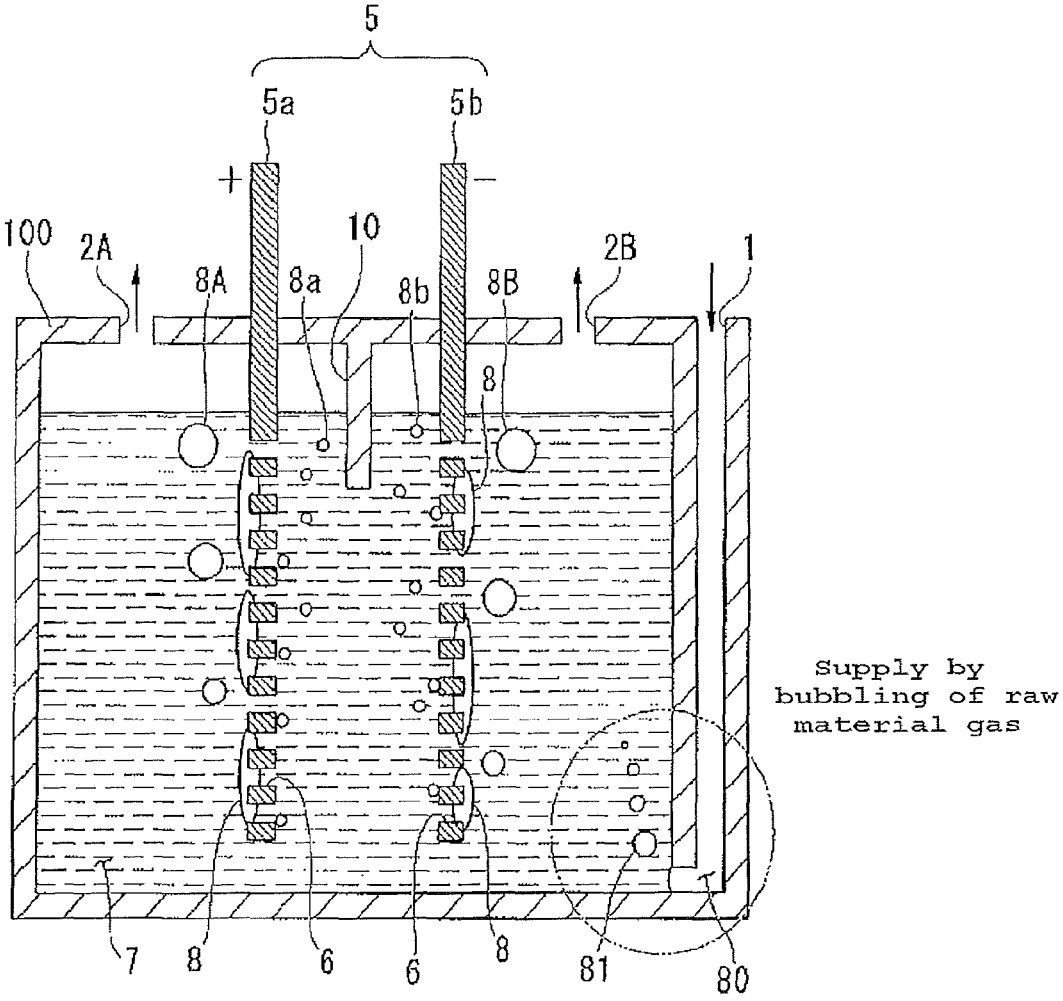
FIG. 1 is a schematic configuration view of an electrolyzer according to present embodiment.

Embodiments of the present invention will be illustrated below with reference to the drawings. Incidentally, in all drawings, the same components are assigned the same reference numerals and therefore their appropriate explanation will be omitted.

The first embodiment will be described below with reference to FIG. 1.

(First Embodiment)

The electrolyzer according to present embodiment is provided with an anode 5*a* and a cathode 5*b* which are in contact with an electrolytic solution 7. At least one of the anode 5*a* and the cathode 5*b* is composed of an electric conductor in a gas permeable structure having the following configuration.

(a) The electrolyzer is provided with a gas generating surface α at which a gas is generated by electrolysis of the electrolytic solution 7, a plurality of through holes 6 passing to a gas releasing surface β, and a gas releasing surface β for releasing the gas supplied from the gas generating surface α via the through holes 6.

(b) At least one of the following treatments is performed: (i) a surface treatment which causes the gas generating surface α to be lyophilic for the electrolytic solution 7; or (ii) a surface treatment which causes the gas releasing surface β to be lyophobic for the electrolytic solution 7.

FIG. 1 is a schematic sectional view of an electrolyzer according to present embodiment. As shown in FIG. 1, in the electrolyzer, an electrolytic bath 100 which is a storage tank, is filled with the electrolytic solution 7 containing molten salt, and an electrode 5 connected with a DC power source is immersed in the electrolytic solution 7. The electrode 5 consists of the anode 5*a* (anode electrode) and the cathode 5*b* (cathode electrode).

In one end of the electrolytic bath 100, a gas flow channel inlet 1 (hereinafter referred to as the raw material gas inlet) is arranged. A raw material gas 80 is blowed into the electrolytic solution 7 in the electrolytic bath 100 via the raw material gas inlet 1 and introduced into the electrolytic solution 7 as bubbles 81 from one corner in the bottom of the electrolytic bath 100 (bubbling). Accordingly, the concentration of the electrolytic solution 7 can be maintained and the concentration of the electrolytic solution 7 can be made uniform. Incidentally, the electrolytic bath 100 may be equipped with a stirring means separately arranged which enables the concentration of the electrolytic solution 7 to be uniform by stirring the electrolytic solution 7.

Furthermore, a partition 10 is arranged at the upper part of the nearly center part of the electrolytic bath 100. On both sides of the partition 10, there are arranged the anode 5*a* and the cathode 5*b*. It is configured so as to obtain desired gases separately with the progress of electrolysis without being mixed with each other at both sides of the partition 10.

The electrolytic bath 100 is provided with gas flow channel outlets 2A, 2B (hereinafter referred to as the gas outlets) which are capable of releasing desired gases from the upper space of the electrolytic solution 7.

The gas outlet 2A is configured so as to be able to recover the gas (bubbles 8*a*, 8A) generated on the anode 5*a* with good efficiency. The gas outlet 2B is configured so as to be able to recover the gas (bubbles 8*b*, 8B) generated on the cathode 5*b* with good efficiency.

The anode 5*a* and the cathode 5*b* are provided with gas permeable through holes 6 (fine gas flow channels) which selectively pass the gas. An electrode having these through holes 6 has at least any one of structures such as a mesh structure (FIG. 6), a porous structure (not illustrated), a porous film structure (not illustrated), a structure having a plurality of through holes 6 in the thickness direction of the electric conductor in a film shape or in a plate shape (FIGS. 5, 6 and the like), or a woven fabric structure (FIG. 7).

Figure 2:
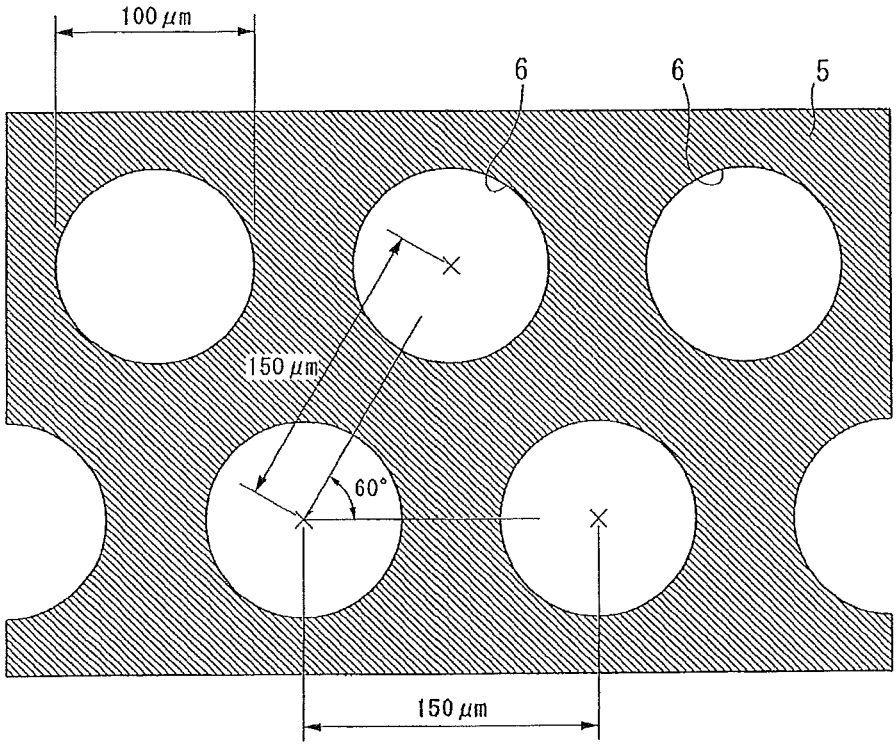
FIG. 2 is an enlarged top plan view of an electrode used for the electrolyzer according to present embodiment.

FIG. 2 is an enlarged top plan view of the electrode 5 used for the electrolyzer according to present embodiment. As shown in FIG. 2, the through holes 6 having a diameter of 100 μm are regularly opened in a zig-zag shape having a pitch of 150 μm at an angle of 60° on the electrode 5.

In present embodiment, depending on the handling gas, the type of the electrolytic solution 7, the shape of the electrolytic bath 100 or the stirring method of the electrolytic solution 7, for example, a plurality of through holes 6 having a diameter of from about 0.05 to 1 mm can be formed and bubbles 8*a*, 8A, 8*b*, 8B generated as a result of electrolysis can also be configured to pass through these through holes 6.

Figure 3:
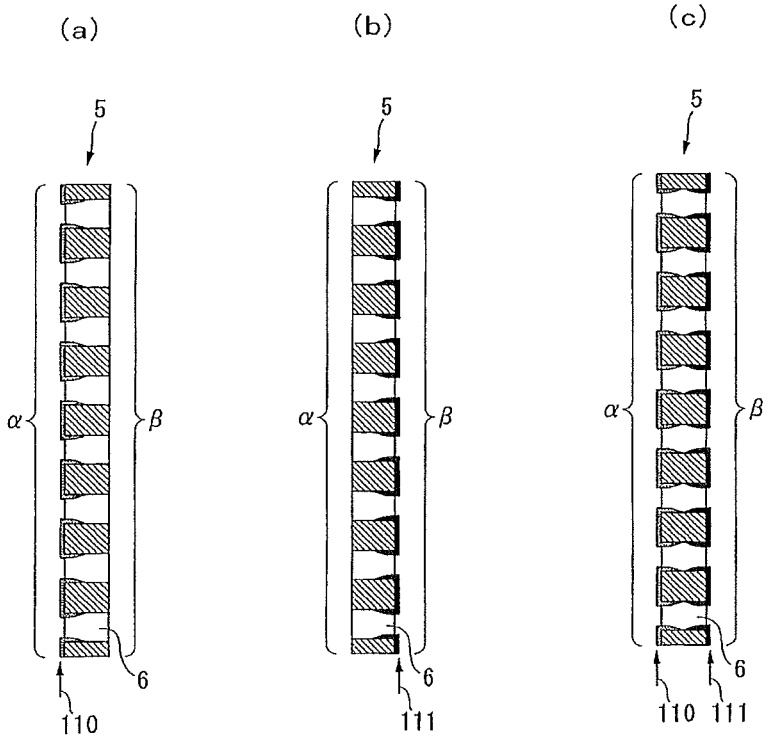
FIG. 3 ((*a*) to (*c*)) is an enlarged vertical sectional view of the electrode used for the electrolyzer according to present embodiment.

FIG. 3 ((*a*) to (*c*)) is an enlarged vertical sectional view of the electrode 5 used for the electrolyzer according to present embodiment. As shown in FIGS. 3(*a*) to 3(*c*), a surface treatment 110 which causes the gas generating surface α to be lyophilic for the electrolytic solution 7 and/or a surface treatment 111 which causes the gas releasing surface β to be lyophobic is performed.

The electrode 5 shown in FIG. 3(*a*) is subjected to the surface treatment 110 which causes the electrode surface facing to a different electrode which is the gas generating surface α (hereinafter referred to as the facing electrode surface, the front face of an electrode or the front face) at which a gas is generated by electrolysis of the electrolytic solution 7 to be lyophilic for the electrolytic solution 7. On the other hand, a back surface of the gas generating surface α which is the gas releasing surface β (hereinafter referred to as the electrode back surface or the back surface), is not subjected to a surface treatment.

When the electrode 5 is immersed in the electrolytic solution 7 for carrying out electrolysis, a gas is generated on the gas generating surface α as a result of electrolysis. Since the lyophilic gas generating surface α is easily compatible with the electrolytic solution 7, the gas (bubbles 8*a*, 8*b*) generated on the gas generating surface α by electrolysis receives a force for moving to the gas releasing surface β which is the back surface of the gas generating surface α via the through holes 6.

When bubbles 8a, 8b are gathered to form bubbles 8 on the gas releasing surface β of the electrode 5, bubbles 8a, 8b move to bubbles 8 with much better efficiency. After all, the gas-liquid separation is performed at the gas-liquid interface between the liquid on the gas generating surface α of the electrode 5 and the gas on the gas releasing surface β of the electrode 5. As a result, the bubbles 8a, 8b can be quickly removed from the gas generating surface α. Then, when the amount of the gas accumulated on the gas releasing surface β is more than the predetermined amount, the gas is discharged as bubbles 8A, 8B (FIG. 1).

Furthermore, in the electrode 5 shown in FIG. 3(*b*), the gas generating surface α is not subjected to a surface treatment, while the gas releasing surface β located at the back surface of the gas generating surface α is subjected to the surface treatment 111 which causes it to be lyophobic for the electrolytic solution 7.

As described above, the gas releasing surface β is lyophobic as compared to the gas generating surface α and is easily compatible with the gas as compared to the electrolytic solution 7. Thus, the gas (bubbles 8a, 8b) generated on the gas generating surface α by electrolysis moves to the gas releasing surface β located at the back surface of the gas generating surface α via the through holes 6. Then, when the amount of the gas of bubbles 8 accumulated on the gas releasing surface β is more than a predetermined amount, the gas is discharged as bubbles 8A, 8B (FIG. 1).

Furthermore, in the electrode 5 shown in FIG. 3(*c*), the gas generating surface α is subjected to the surface treatment 110 which causes it to be lyophilic for electrolytic solution 7, while the gas releasing surface β is subjected to the surface treatment 111 which causes it to be lyophobic for the electrolytic solution 7. The gas generated on the gas generating surface α by electrolysis further effectively moves to the gas releasing surface β located at the back surface of the gas generating surface α via the through holes 6 (FIG. 1).

As described below, bubbles 8a, 8b are quickly removed without attaching to the gas generating surface α by activities relative to the surface tension of the liquid.

As for the surface tension γ[N/m] of the liquid, the contact angle θ [deg] between the electrode and the liquid, and the radius r[m] of the through hole of the electrode, the pressure required for putting the liquid into the inside of holes which is the Young-Laplace pressure ΔP, is defined below.

$$\Delta P = -2\gamma\cos\theta/r$$

The pressure generated in the electrolytic solution 7 includes the pressure by the depth of the electrolytic solution 7. However, when the pressure is not more than the above ΔP, the electrolytic solution 7 cannot be passed through the through holes 6 of the electrode 5, and bubbles 8 are more stably formed on the gas releasing surface β and maintained.

In present embodiment, the through holes 6 of the electrode 5 are formed in consideration of the above equation.

Hereinafter, the structure of the electrode 5 which can be used in present embodiment will be further illustrated.

Figure 5:
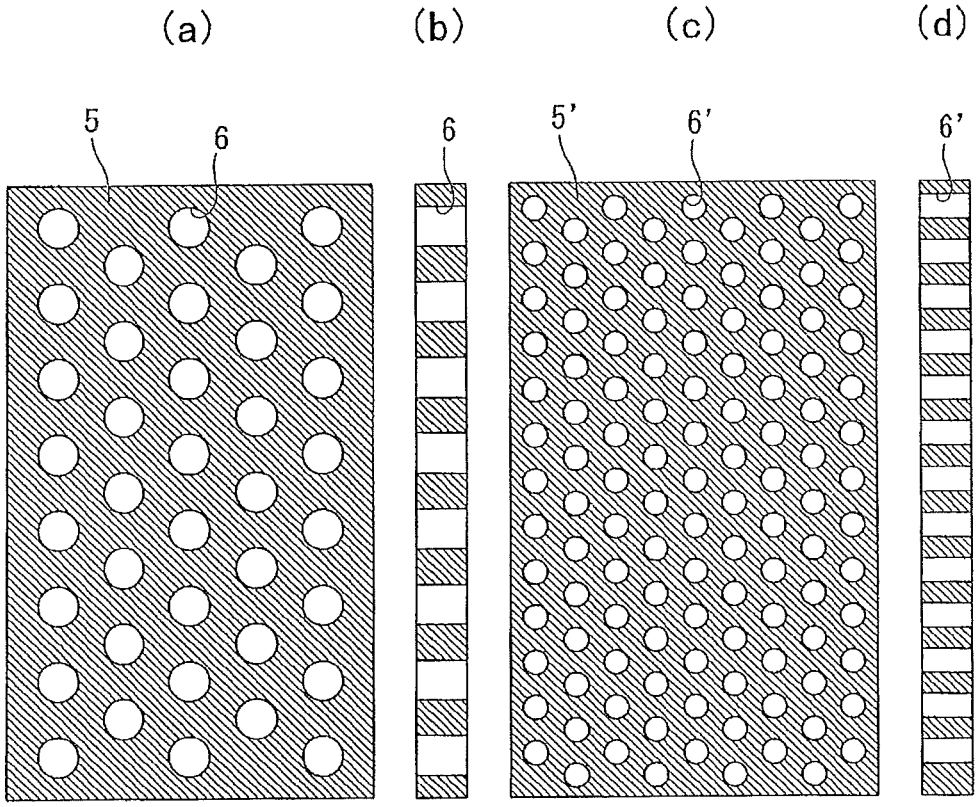
FIG. 5(*a*) is an elevational view and FIG. 5(*b*) is a vertical sectional view of the electrode used for the electrolyzer according to present embodiment, while FIG. 5(*c*) is an elevational view and FIG. 5(*d*) is a vertical sectional view of another electrode.

FIG. 5(*a*) is an elevational view and FIG. 5(*b*) is a vertical sectional view of the electrode 5 used for the electrolyzer according to present embodiment.

The electrode 5' illustrated in FIGS. 5(*c*) and 5(*d*) is an electrode in which the size of the through hole 6' is smaller than that of electrode 5 illustrated in FIGS. 5(*a*) and 5(*b*), and the number of through holes 6' is greater. FIG. 5(*c*) is an elevational view and FIG. 5(*d*) is a vertical sectional view of the electrode 5'. Besides, in the electrode 5 shown in FIGS. 5(*a*) and 5(*b*), the size, shape and arrangement of the through holes 6 are properly selected, whereby a desired electrode structure can be achieved.

Figure 6:
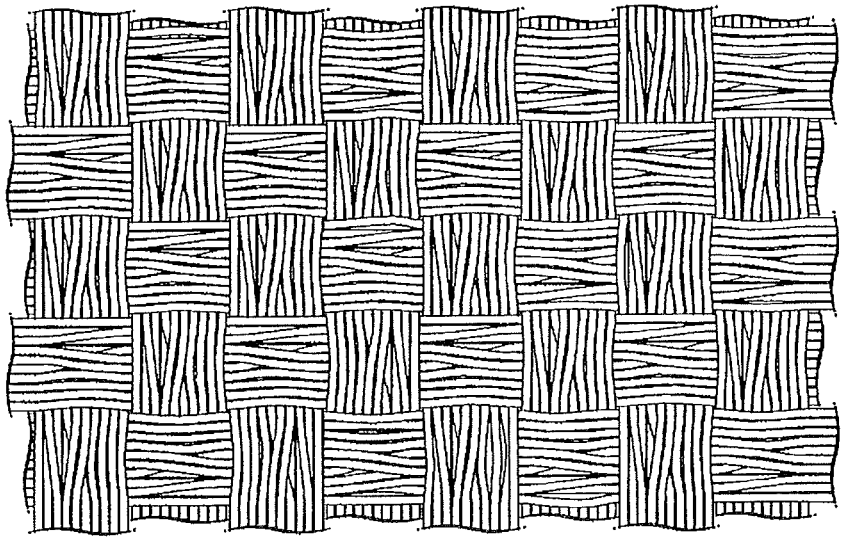
FIG. 6 is an enlarged top plan view of a mesh electrode used for the electrolyzer according to present embodiment.
Figure 7:
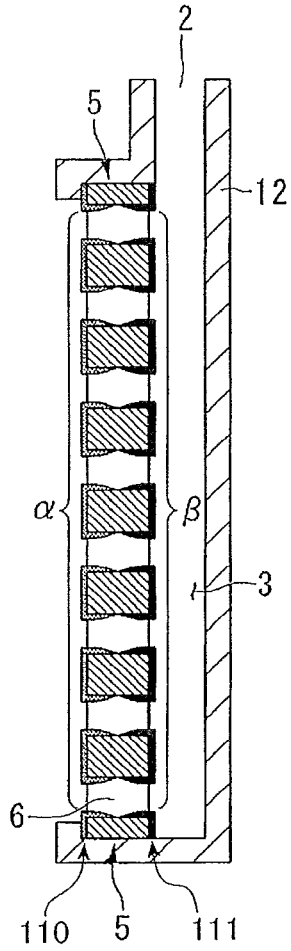
FIG. 7 is a schematic configuration view of a ventilation duct-equipped electrode used for electrolyzer according to present embodiment.

FIG. 6 is an enlarged top plan view of an electrode in a mesh structure used for the electrolyzes according to present embodiment. As shown in FIG. 6, the mesh electrode obtained by weaving a plurality of conductive fibers thereinto allows respective fibers to secure gaps in a predetermined range. Accordingly, fine gas flow channels can be secured by these gaps.

These fine gas flow channels prevent the electrolytic solution 7 from being infiltrated thereinto, permeated therethrough or soaked therein by the surface tension, and a plurality of channels are formed with holes small enough to be able to pass only the generated gas as channels. Incidentally, the structure of the mesh electrode is not restricted to the structure of FIG. 6. As long as the fine gas flow channels are formed, a way of weaving conductive fibers can be properly selected.

Hereinafter, a method for producing the electrodes 5 (5') illustrated in FIG. 5 will be described.

First, the through holes 6 (6') are prepared on an electrode plate composed of an electric conductor in a plate shape or in a film shape by drilling process, laser process, sandblasting process or the like. Furthermore, an electrode plate in a porous structure or the like prepared with an electric conductor can also be used. Examples of the electric conductor include carbon material and metal.

The gas generating surface α of the electrode plate may be subjected to a surface treatment which causes it to be lyophilic for the electrolytic solution 7. Examples of the surface treatment for imparting the lyophilic property include plasma treatment, ozone treatment, corona discharge treatment and the like.

On the other hand, the gas releasing surface β located at the back surface of the gas generating surface α (a surface which does not face the other electrode) may be subjected to a surface treatment which causes it to be lyophobic for the electrolytic solution 7. Examples of the surface treatment for imparting the lyophobic property include fluorine resin coating, plasma treatment by a fluorine gas, fluorine gas treatment and the like. Examples of the fluorine resin coating material include polytetrafluoroethylene (PTFE) and amorphous fluorine resins (product name: CYTOP (a product of Asahi Glass Co., Ltd.)).

Meanwhile, as other production methods, the following methods can be cited.

First, a laminate plate is prepared by laminating a sheet material which is lyophobic for the electrolytic solution 7 on an electrode plate, and the through holes are formed on the laminated plate by drilling process, laser process, sandblasting process or the like. Then, the electrode plate surface is subjected to the aforementioned surface treatment so as to cause it further to be lyophilic.

Furthermore, there can be used a method in which a porous material or a mesh prepared with a material which is lyophobic for the electrolytic solution 7 is attached to one surface of the porous electrode or the electrode in a mesh structure, and the surface is subjected to the aforementioned surface treatment so as to cause it to be lyophilic.

Meanwhile, in any of the anode 5a or the cathode 5b, there becomes a problem of deterioration of the electrode on the gas generating surface. So, when bubbles are required to be quickly removed, the aforementioned electrode can be used for any of the anode 5a and the cathode 5b as in present embodiment. On the other hand, when deterioration of one of the electrodes does not cause a problem, that electrode may be in a usual rod shape, in a plate shape, or in a cylindrical shape so as to surround the other electrode.

In present embodiment, an example of the electrolytic solution 7 includes molten salt containing hydrogen fluoride. As the raw material gas 80, a hydrogen fluoride gas can be used. In this case, the gas generated on the gas generating surface α of the anode 5*a* is a fluorine gas, while the gas generated on the gas generating surface α of the cathode 5*b* is a hydrogen gas.

Hereinafter, effects of the electrolyzer according to present embodiment will be illustrated.

In the electrolyzer of present embodiment, there is used an electrode which is subjected to at least one of a surface treatment which causes the gas generating surface α to be lyophilic for the electrolytic solution 7 and a surface treatment which causes the gas releasing surface β to be lyophobic for the electrolytic solution 7.

Accordingly, bubbles 8*a*, 8*b* on the surface of the gas generating surface α can be quickly removed, and attachment of bubbles to the electrode surface and accordingly generation of an insulating compound are suppressed. Therefore, the current density per unit area of the electrode becomes uniform over a long period of time and the desired gases can be effectively obtained by electrolysis.

Furthermore, when the gas generating surface α and the gas releasing surface β are brought into contact with the electrolytic solution 7, bubbles 8*a*, 8*b* generated on the surface of the gas generating surface α form bubbles 8 on the gas releasing surface β. Accordingly, bubbles 8*a*, 8*b* further easily move to the gas releasing surface β so that bubbles 8*a*, 8*b* on the surface of the gas generating surface α can be removed with much better efficiency.

Further, the through holes 6 of the electrode 5 selectively pass the gas generated on the gas generating surface α. That is, even when the pressure (fluid pressure) according to its depth is generated in the electrolytic solution 7, outflow of the electrolytic solution 7 to a side of bubbles 8 is suppressed.

Accordingly, movement of the electrolytic solution 7 to a side of the gas releasing surface β via the through holes 6 can be suppressed so that electrolysis can be carried out with good efficiency without preventing movement of the bubbles 8*a*, 8*b*.

Furthermore, in the electrolyzer of present embodiment, the storage tank (electrolytic bath 100) is filled with the electrolytic solution 7.

In present embodiment, the electrode 5 subjected to the surface treatment as described above is used and bubbles 8*a*, 8*b* can be easily removed from the gas generating surface α so that prevention of electrolysis due to the generated gases can be suppressed. Accordingly, the relatively large-scale device can be configured, and the desired gases can be supplied with good efficiency and in large quantities.

In present embodiment, the anode 5*a* and the cathode 5*b* are arranged in parallel, and the gas generating surface α of the anode 5*a* and the gas generating surface α of the cathode 5*b* are oppositely disposed to each other.

Accordingly, the area efficiency in the electrolyzer is improved, and the degree of freedom in the design of the electrode structure and the electrolytic bath is improved.

In present embodiment, at least one of the anode 5*a* and the cathode 5*b* is immersed in the direction perpendicular to the liquid surface of the electrolytic solution 7.

Accordingly, removal of bubbles 8*a*, 8*b* from the gas generating surface α is accelerated so that the current density per unit area of the electrode becomes uniform over a long period of time. Thus, the desired gases can be obtained by electrolysis with good efficiency.

In present embodiment, the electrolyzer is configured such that the raw material gas 80 can be supplied to the electrolytic solution 7 from the raw material gas supply unit.

Accordingly, electrolysis can be continuously carried out and the concentration of the raw material can be maintained at a constant level so that the desired gases can be obtained with good efficiency.

Furthermore, to supply the raw material gas 80 to the electrolytic solution 7 from the raw material gas supply unit, the raw material gas 80 can be introduced into the electrolytic solution 7 from the bottom of the electrolytic bath 100 by bubbling.

Accordingly, even though stirring of the electrolytic solution 7 is not perfect because the volume of the electrolytic bath 100 is not sufficient, the interval between the anode 5*a* and the cathode 5*b* is narrow, or the like, the concentration of the raw material can be made uniform in the inside of the electrolytic bath 100 or in the vicinity of the electrode 5, and the current density on the surface of the electrode 5 can be made uniform. Accordingly, electrolysis is carried out with good efficiency so that the desired gases can be obtained. At this time, it is preferable to cause natural convection to occur in the electrolytic solution 7 by locally heating the electrolytic bath 100. Further, it is also possible to force the solution to flow by a pump or the like.

(Second Embodiment)

The electrolyzer according to the second embodiment will be illustrated below with reference to FIGS. 7 and 8.

As shown in a schematic configuration view of the electrode 5 in FIG. 7, there is arranged a gas storage unit 12 (hereinafter referred to as the ventilation duct) for covering the gas releasing surface β of the electrode 5 and having a gas flow channel 3 in its interior for receiving the gas released from the gas releasing surface β.

Figure 8:
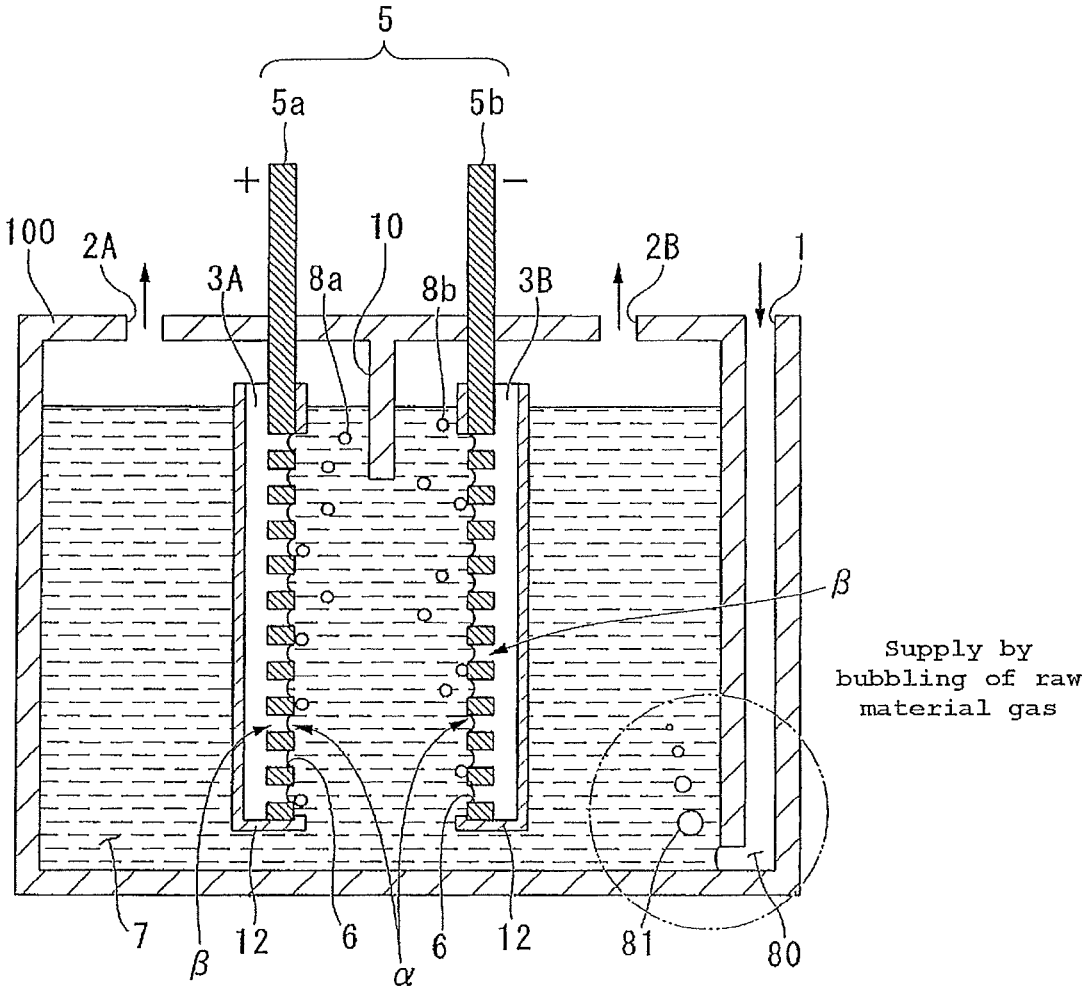
FIG. 8 is a schematic configuration view of an electrolyzer using the ventilation duct-equipped electrode according to present embodiment.

Accordingly, as shown in FIG. 8, bubbles 8*a*, 8*b* generated on the gas generating surface α with the progress of electrolysis are quickly discharged to the gas flow channels 3A, 3B of the gas storage unit 12 in the gas releasing surface β. The gas storage unit 12 is provided with an opening portion in the upper part, and the gases released from the opening portion are discharged from the gas flow channel outlets 2A, 2B (discharge port) and recovered.

Figure 9:
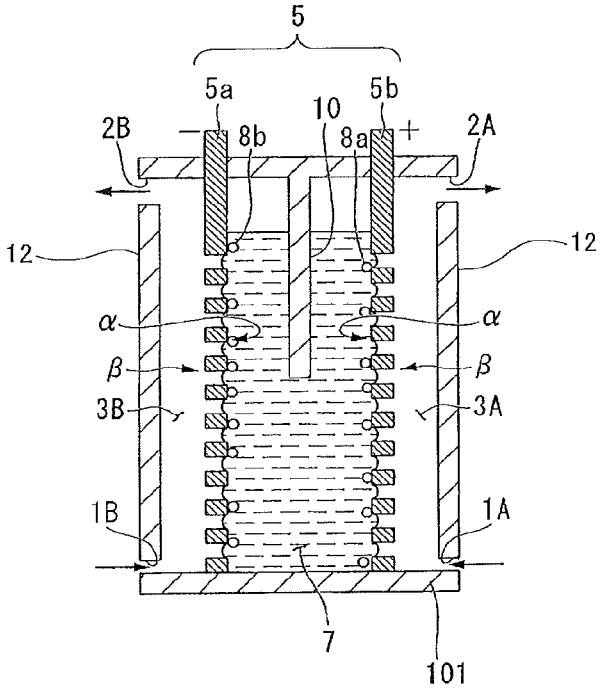
FIG. 9 is a schematic configuration view of an electrolyzer with a gas flow channel arranged on a gas releasing surface according to present embodiment.

FIG. 9 is another aspect of an electrolyzer according to present embodiment, which is different from the electrolyzer as shown in FIG. 8. The electrolytic solution 7 is filled only between the anode 5*a* and the cathode 5*b*. The electrolytic bath 100 is provided with inert gas supply units 1A, 1B and it is configured such that an inert gas such as nitrogen, helium or the like can be supplied to the gas flow channels 3A, 3B from the inert gas supply units 1A, 1B. Accordingly, the generated gases from the gas flow channel outlets 2A, 2B (discharge port) are discharged and recovered.

The electrolyzer in FIG. 9 can be configured so as to supply the raw material gas in place of the inert gas to the electrolytic solution 7 via the through holes 6 in the anode 5*a* and/or cathode 5*b*.

Via the through holes 6 capable of selectively passing the gases, the raw material gas is supplied to the electrolytic solution 7 from the gas storage unit 12 and dissolved in the electrolytic solution 7. Then, bubbles 8*a*, 8*b* generated by electrolysis move to the inside of the gas storage unit 12 from the gas generating surface α. Since the raw material gas is easily dissolved in the electrolytic solution 7, the raw material gas is selectively passed through the through holes 6 and dissolved in the electrolytic solution 7. That is, the desired generated gases are passed through the through holes 6 in the electrode 5 in the direction of the gas releasing surface β from the gas generating surface α of the electrode 5 and they are separated, while the raw material gas is passed through the through holes 6 of the electrode 5 in the direction of the gas generating surface α from the gas releasing surface β of the electrode 5 and dispersed in the electrolytic solution 7, thereby replenishing the raw material.

In present embodiment, using molten salt containing hydrogen fluoride as the electrolytic solution, a hydrogen fluoride gas supplied to the gas storage unit 12 of the cathode side generating a hydrogen gas is exemplified as a raw material gas.

Figure 27:
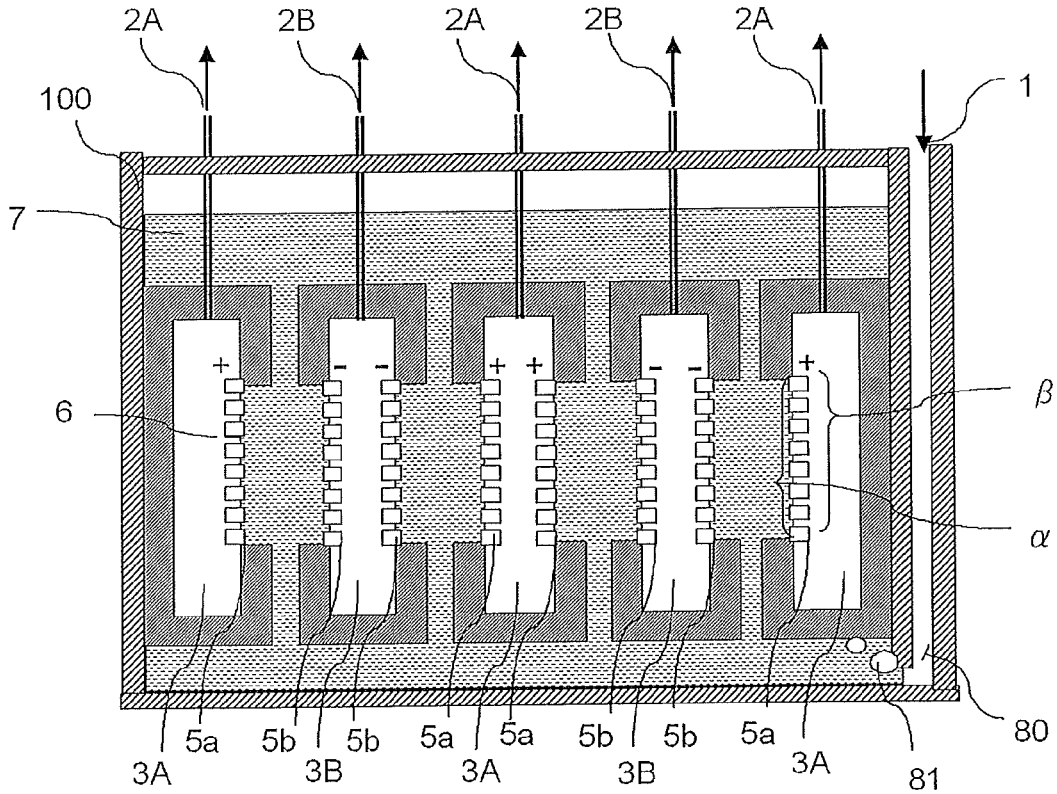
FIG. 27 is a schematic configuration view of an electrolyzer equipped with a gas storage unit surrounding all opposing gas generating surfaces according to present embodiment.

FIG. 27 is another aspect of an electrolyzer according to present embodiment, which is different from the electrolyzer as shown in FIG. 8. The gas storage unit 12 is arranged so as to surround both the gas releasing surfaces β, β facing to each other. The gases released from the gas releasing surface β are quickly discharged to the gas flow channels 3A, 3B in the gas storage unit 12. The gas storage unit 12 is provided with gas flow channel outlets 2A, 2B (discharge port) in the upper part, and the generated gases are discharged from the gas flow channel outlets 2A, 2B and recovered.

Hereinafter, effects of the electrolyzer according to present embodiment will be illustrated.

The electrolyzer in present embodiment is provided with the gas storage unit 12 for covering the gas releasing surface β of at least one of the anode 5*a* and the cathode 5*b* and receiving the gas discharged from the gas releasing surface β.

When the gas releasing surface β is covered with the gas, bubbles 8*a*, 8*b* effectively move to a side of the gas releasing surface β via the through holes 6 so that deterioration of the electrode 5 can be suppressed and a capability to recover the generated gases can also be improved. Accordingly, the electrolyzer in present embodiment can be preferably used for relatively large-scale devices.

Furthermore, another electrolyzer of present embodiment is configured to be able to ventilate by supplying the inert gas to the inside of the gas storage unit 12 from the inert gas supply units 1A, 1B.

By supplying of the inert gas, the flow of the gases is formed in the inside of the gas flow channels 3A, 3B so that the surface tension works for absorbing the gases 8*a*, 8*b* into the inside of the gas flow channels 3A, 3B. Accordingly, electrolysis can be carried out with good efficiency.

The electrolyzer in present embodiment is provided with gas supply units at the gas storage unit 12 of the anode 5*a* or the cathode 5*b*, and is configured so as to be able to supply the raw material gas supplied from the gas supply unit to the electrolytic solution 7 via the through holes 6.

Accordingly, electrolysis can be continuously carried out and the concentration of the raw material can be maintained at a constant level so that electrolysis can be carried out with good efficiency.

The electrolyzer in present embodiment is provided with at least two pairs of anodes 5*a* and cathodes 5*b*. At least one of the gas releasing surfaces β of the anodes 5*a* and the gas releasing surfaces β of the cathodes 5*b* are oppositely disposed to each other. There is arranged the gas storage unit 12 for covering any of a pair of the gas releasing surfaces β facing to each other.

Accordingly, the device configuration can be simplified and the degree of freedom in the design of the electrolytic bath is improved.

(Third Embodiment)

The electrolyzer according to the third embodiment will be illustrated below with reference to FIGS. 10 to 13.

FIGS. 10 to 13 illustrate an electrolyzer having an anode and a cathode which are arranged horizontally to the liquid surface of the electrolytic solution 7 and in which the gas generating surface is brought into contact with the liquid surface of the electrolytic solution 7.

Figure 10:
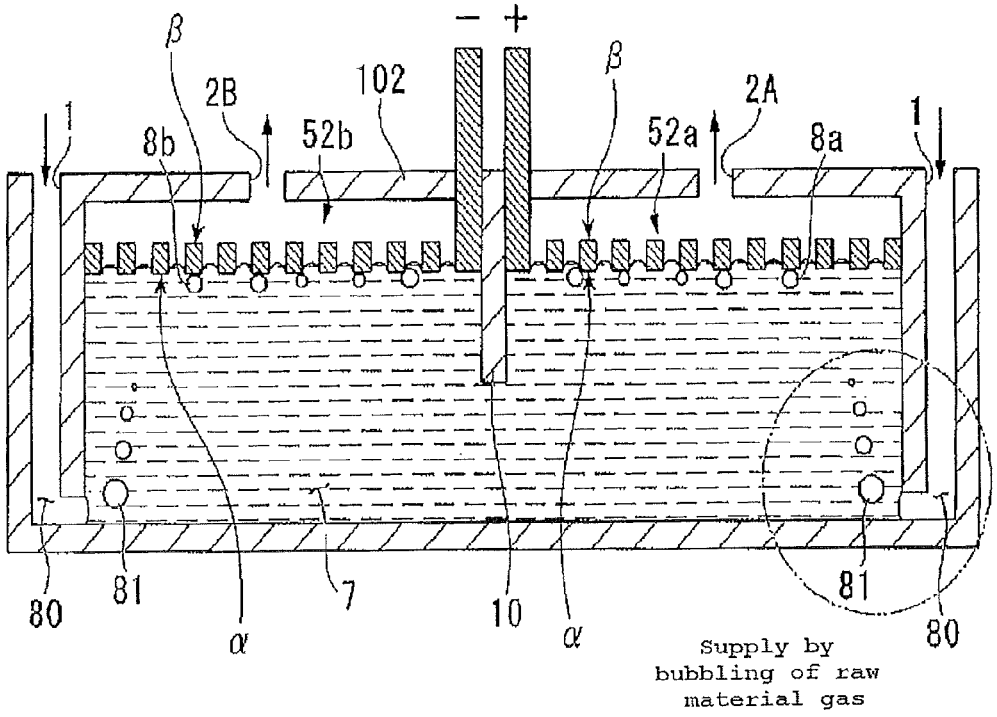
FIG. 10 is a schematic configuration view of an electrolyzer using an electrode in a drop-lid shape according to present embodiment.

FIG. 10 is a schematic configuration view of the electrolyzer in which the gas generating surface α of any of the anode 52*a* and the cathode 52*b* is brought into contact with the liquid surface of the electrolytic solution 7. To decide the position of these electrodes, there can be exemplified a method for being floated the electrode on the liquid surface of the electrolytic solution 7, a method for controlling the liquid surface at all times, or the like. According to this configuration, bubbles 8*a*, 8*b* can be quickly recovered.

Also, the anode 52*a* or the cathode 52*b* can be configured to be able to move vertically.

Figure 11:
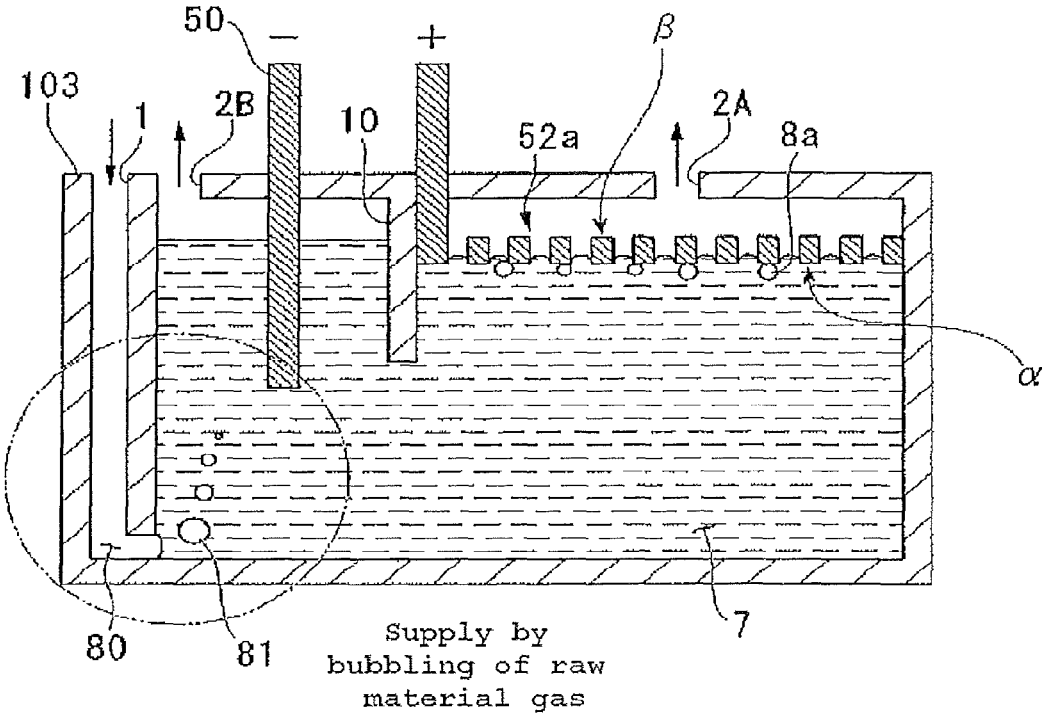
FIG. 11 is a schematic configuration view of an electrolyzer using an electrode in a drop-lid shape according to present embodiment.

FIG. 11 is a schematic configuration view of the electrolyzer in which only the anode 52*a* having the through holes 6 is brought into contact with the liquid surface of the electrolytic solution 7 on its gas generating surface α. Herein, as a cathode 50, an electrode without having any through holes formed thereon is used. The cathode 50 may be in a rod shape or in a plate shape. When the gas generated at the cathode 50 does not hinder electrolysis, such a configuration can also be adopted.

In present embodiment, an example of the electrolytic solution 7 includes molten salt containing hydrogen fluoride. The gas generated on the gas generating surface α of the anode 52*a* is a fluorine gas, while the gas generated at the cathode 52*b* is a hydrogen gas.

Furthermore, as another embodiment of the present invention, there can also be cited an electrolyzer which is provided with an electrode 53 consisting of a plurality of strip-shaped electrodes arranged by spacing at almost equal intervals from one another, and in which electrolysis is carried out by applying a DC voltage between electrodes located at both ends of a plurality of said strip-shaped electrodes.

Figure 12:
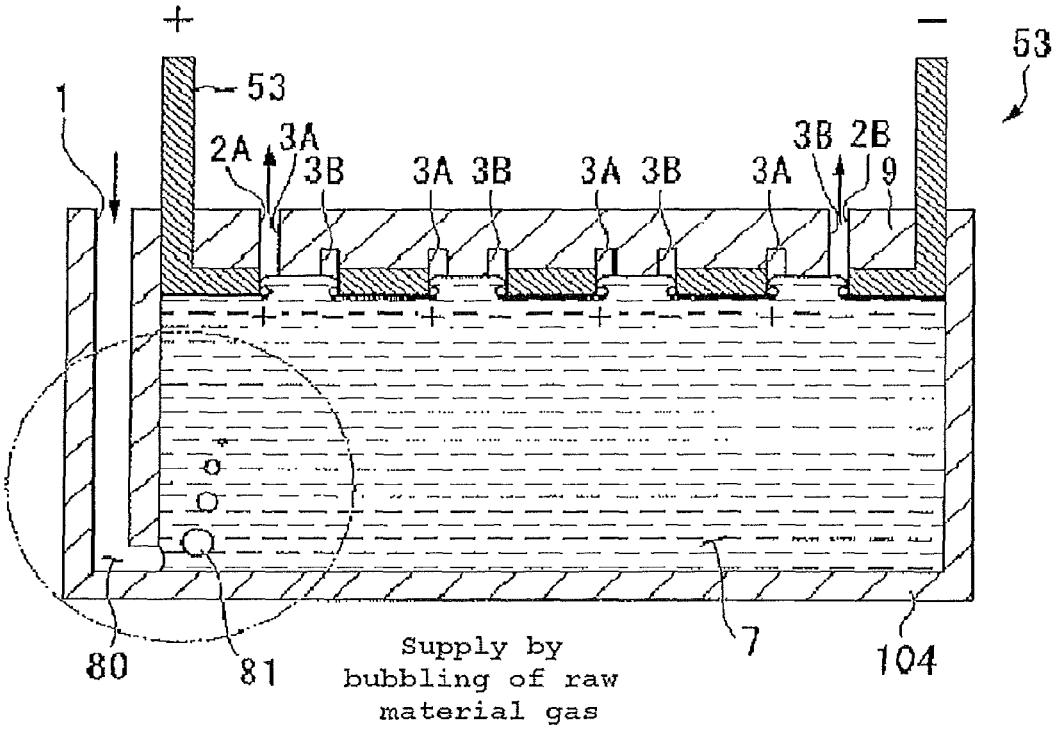
FIG. 12 is a schematic configuration view of an electrolyzer using a plurality of strip-shaped electrodes according to present embodiment.

FIG. 12 is a schematic configuration view of the electrolyzer equipped with the electrode 53 dividedly arranged in which the gas generating surface is brought into contact with the liquid surface of the electrolytic solution 7. The electrode 53 is arranged at under surface side of an upper cover 9, and electrodes at both ends have L-shaped cross-sections and are protruded to the outside of an electrolytic bath 104 in the manner that a DC voltage can be applied therebetween.

As shown in FIG. 12, the gas flow channels 3A, 3B are arranged at the under surface of the upper cover 9 between the electrodes divided in a strip shape. The gas flow channel 3A is a flow channel for the gas generated at the anode, while the gas flow channel 3B is a flow channel for the gas generated at the cathode. The gas collected through the gas flow channel 3A is led to the gas flow channel outlet 2A, while the gas collected through the gas flow channel 3B is led to the gas flow channel outlet 2B.

Figure 4:
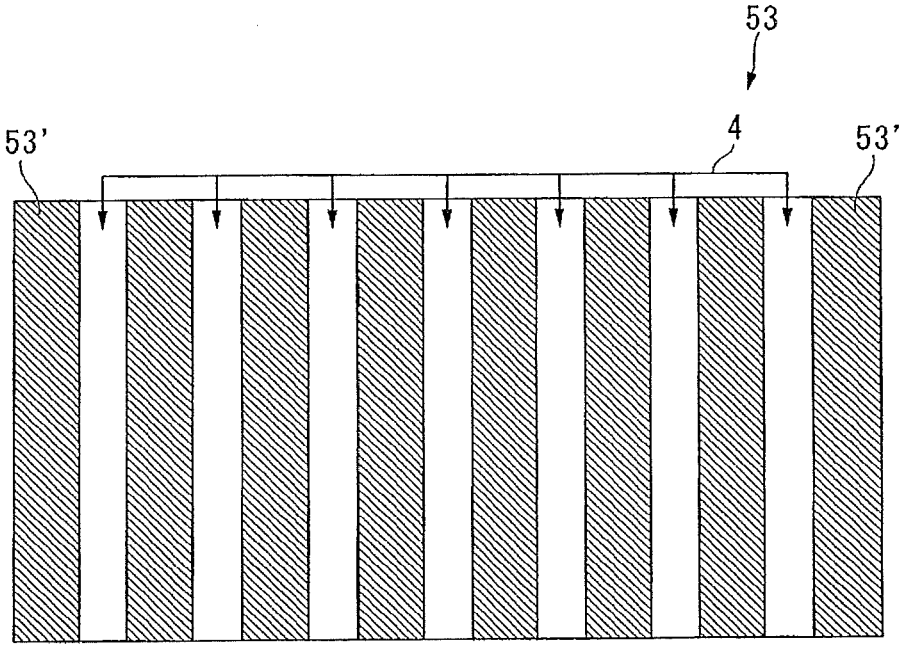
FIG. 4(*a*) is an elevational view, while FIG. 4(*b*) is a top view of the electrode for the electrolyzer according to present embodiment.
Figure 4:
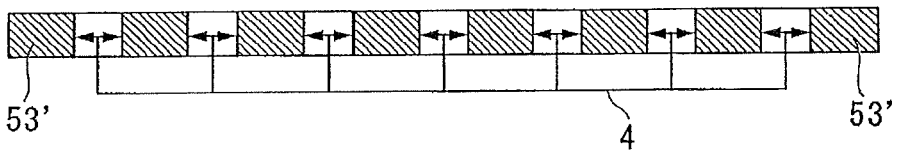

In FIGS. 4(*a*) and 4(*b*), the electrode 53 to be used for the electrolyzer of FIG. 12 is illustrated.

FIG. 4(*a*) is an elevational view of the electrode 53, while FIG. 4(*b*) is its side view. As shown in FIGS. 4(*a*) and 4(*b*), the electrode 53 is composed of a plurality of electrodes divided in a strip shape and arranged by spacing gaps 4 from one another, and a DC voltage can be applied between electrodes 53', 53' located at its both ends.

As shown in FIG. 12, to generate gases at the divided electrodes, it is necessary that the distance between the electrode 53' and the electrode 53' is shorter than the length in the longitudinal direction of the divided electrodes.

Figure 13:
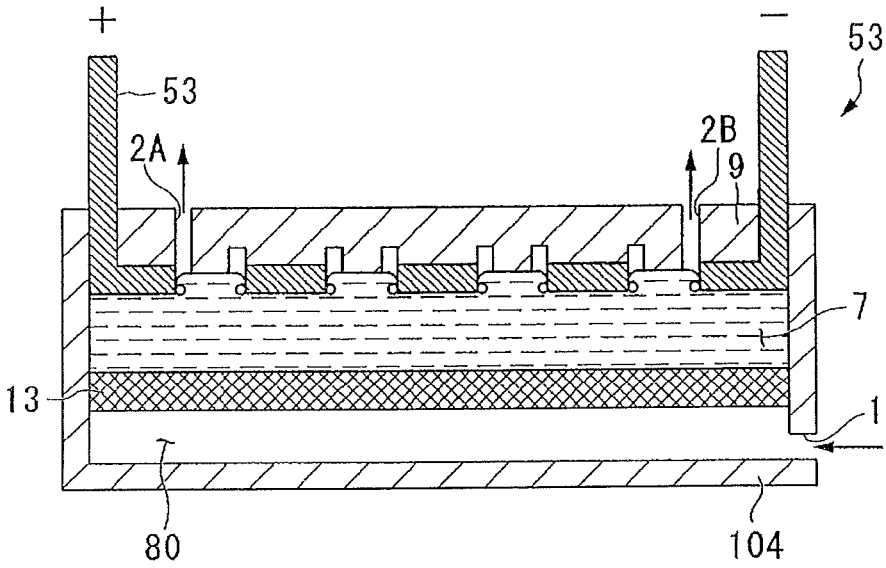
FIG. 13 is a schematic configuration view of an electrolyzer using a plurality of strip-shaped electrodes according to present embodiment.

FIG. 13 illustrates a configuration of the electrolyzer in FIG. 12 such that the raw material gas 80 can be supplied to the electrolytic solution 7 from the lower part. Specifically, a bottom substrate 13 allowing only the gas to pass therethrough is arranged at the bottom of the electrolytic bath 104. A space is formed between the electrolytic bath 104 and the bottom substrate 13. When the raw material gas is fed under pressure into the space, the raw material can be supplied to the electrolytic solution 7 located at the upper part of the bottom substrate 13. On the other hand, the electrolytic solution 7 does not permeate through the bottom substrate 13 downward nor is leaked out.

According to such a configuration of the electrolyzer, in the electrolytic solution 7 of the same electrolytic bath 104, there is an effect of electrochemical activities substantially equivalent to direct connection without connecting using a wire or the like between the electrodes 53' located at both ends of the divided electrode 53. When electrolysis is carried out using a row of these electrodes 53' to 53' in rows, the efficiency in removing bubbles is improved because bubbles 8*a*, 8*b* are removed from the gas flow channels 3A, 3B (refer to FIGS. 4 and 12).

Hereinafter, effects of the electrolyzer according to present embodiment will be illustrated.

In the electrolyzer (FIGS. 10 and 11) of present embodiment, at least one of the anode 52*a* and the cathode 52*b* is arranged horizontally to the liquid surface of the electrolytic solution 7 and the gas generating surface α is brought into contact with the liquid surface of the electrolytic solution 7.

Accordingly, since the gas releasing surface β is covered with the gas and the bubbles 8*a*, 8*b* move to a side of the gas releasing surface β more quickly, the efficiency in recovering the bubbles 8*a*, 8*b* can be improved. Furthermore, even when lyophilic property of the gas generating surface α brought into contact with the electrolytic solution 7 is lowered, the electrolytic solution 7 does not move to a side of the gas releasing surface β via the through holes 6 so that a gas phase and a liquid phase are easily separated, and a capability to recover the gases is not lowered.

Furthermore, in present embodiment, at least one of the anode 52*a* and the cathode 52*b* arranged horizontally to the liquid surface of the electrolytic solution 7 is configured to be able to move vertically and the gas generating surface α is brought into contact with the liquid surface of the electrolytic solution 7. Accordingly, the position of the electrode 52*a* may be easily decided and maintenance becomes easy.

Meanwhile, the electrolyzer illustrated in FIGS. 12 and 13 is provided with the electrode 53 consisting of a plurality of strip-shaped electrodes arranged by spacing at almost equal intervals from one another, and electrolysis is carried out by applying in a DC voltage between electrodes 53' located at both ends of a plurality of said strip-shaped electrodes.

Accordingly, there is an effect of activities substantially equivalent to direct connection without connecting using a wire or the like between electrodes 53 consisting of a plurality of strip-shaped electrode in the electrolytic solution. Then, when electrolysis is carried out using a row of the aforementioned electrodes, the efficiency in removing bubbles is improved because bubbles are removed from the gaps.

(Fourth Embodiment)

The electrolyzer according to the fourth embodiment will be illustrated below with reference to FIGS. 14 and 15.

Figure 14:
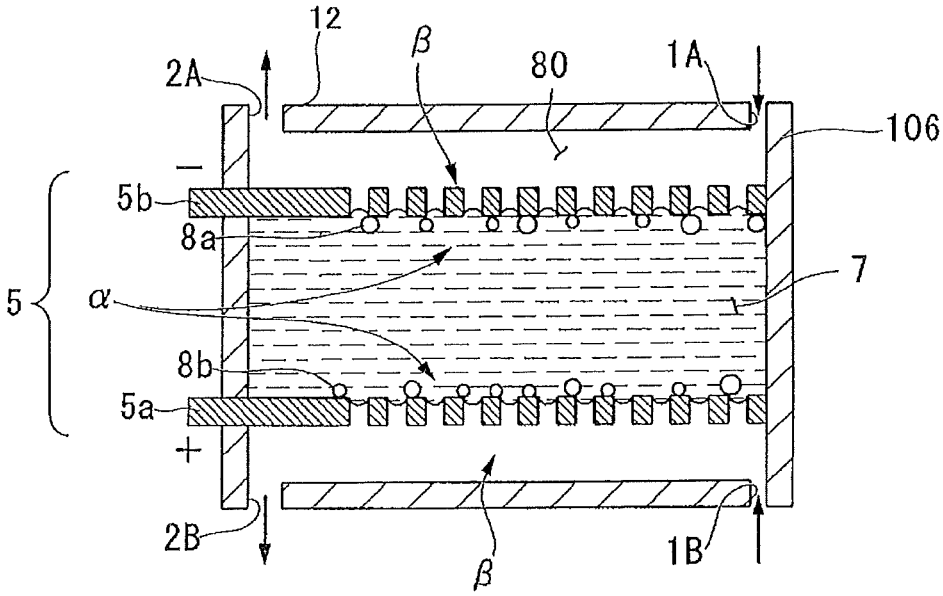
FIG. 14 is a schematic configuration view of an electrolyzer with an anode and a cathode horizontally arranged according to present embodiment.
Figure 15:
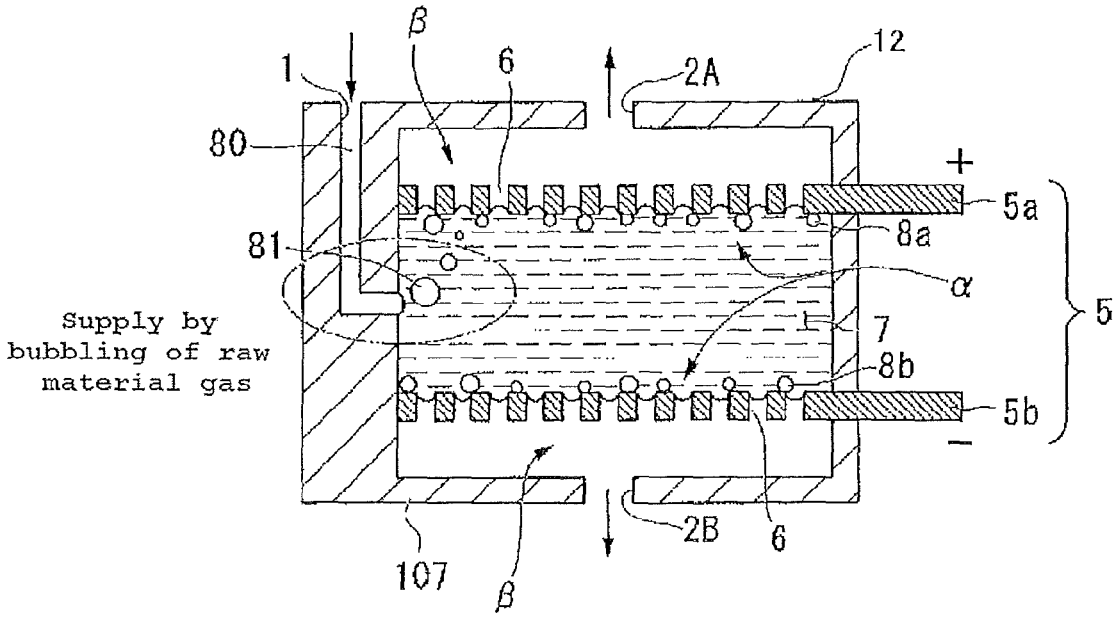
FIG. 15 is a schematic configuration view of an electrolyzer with an anode and a cathode horizontally arranged according to present embodiment.

As shown in FIGS. 14 and 15, the anode 5*a* and the cathode 5*b* are oppositely disposed to each other and at the same time horizontally disposed. The electrolytic solution 7 is filled between these electrodes.

The electrolyzer of FIG. 14 is configured such that the raw material gas 80 can be supplied to the inside of the gas storage unit through a gas flow channel inlet 1A (inlet port) arranged in an electrolytic bath 106, and the raw material gas 80 is supplied to the electrolytic solution 7 via the through holes 6 of the cathode 5*b*. Herein, it can also be configured such that the raw material gas 80 is supplied to the electrolytic solution 7 via the through holes 6 of the anode 5*a*.

Via the through holes 6 capable of selectively passing the gases, the raw material gas is supplied to the electrolytic solution 7 from the gas storage unit and dissolved in the electrolytic solution 7. Then, the bubbles 8*a* generated by electrolysis move to the gas storage unit from the gas generating surface α. Since the raw material gas 80 is easily dissolved in the electrolytic solution 7, the raw material gas is selectively passed through the through holes 6 and dissolved in the electrolytic solution. Namely, the desired generated gases are passed through the through holes 6 of the electrode in the direction of the gas releasing surface β from the gas generating surface α of the electrode 5. On the other hand, the raw material gas is passed through the through holes 6 of the electrode 5 in the direction of the gas generating surface α from the gas releasing surface β of the electrode 5 and dispersed in the electrolytic solution 7. Accordingly, the raw material can be additionally supplied to the electrolytic solution 7.

When all the bubbles 8*a*, 8*b* are desired gases, the electrolyzer can be configured so as to recover only desired generated gases without replenishing the raw material gas 80 via the through holes 6 of the electrode for generating the desired gases. In present embodiment, using molten salt containing hydrogen fluoride as the electrolytic solution, a hydrogen fluoride gas supplied to the gas storage unit of the cathode side for generating a hydrogen gas is exemplified as the raw material gas 80.

FIG. 15 is a schematic configuration view of an electrolyzer for bubbling the raw material gas into the electrolytic solution 7 in the electrolyzer illustrated in FIG. 14.

In the aforementioned electrolyzer with reference to FIG. 14, the raw material gas is supplied via the through holes 6 of the electrode 5. Instead, the electrolyzer as shown in FIG. 15 is configured so as to directly cause bubbling to the electrolytic solution 7. Specifically, the raw material gas 80 is supplied directly to the electrolytic solution 7 from the gas flow channel inlet 1 in an electrolytic bath 107.

When the interval between the anode 5*a* and the cathode 5*b* is apart from each other, harmful effects such as increase of the electrolytic voltage and the like occur in some cases. So, the interval between the anode 5*a* and the cathode 5*b* is set narrow in order to achieve the desired electrolytic voltage in some cases.

When the interval between the anode 5*a* and the cathode 5*b* is narrowed, a convection current by heating or a convection current by bubbling hardly takes place between these electrodes. Thereby, since the concentration of the electrolytic solution 7 between the electrodes is lowered or the concentration becomes non-uniform, the electric field becomes non-constant in some cases. Furthermore, when the depth (distance between the anode 5*a* and the cathode 5*b*) of the electrolytic bath 107 is shallow as compared to the width and area of the electrode 5 or the width and area of the electrolytic bath 107, a convection current by heating or a convection current by bubbling hardly takes place. Thereby, since the concentration of the electrolytic solution 7 between the electrodes is lowered or the concentration becomes non-uniform, the electric field becomes non-constant in some cases. In order to solve this phenomenon, in FIG. 15, a method for supplying the raw material gas 80 from the gas releasing surfaces β of the anode 5*a* and the cathode 5*b* can also be adopted.

Hereinafter, effects of the electrolyzer according to present embodiment will be illustrated.

The electrolyzer of present embodiment is provided with a gas supply unit arranged at the gas storage unit 12 of the anode 5*a* or the cathode 5*b*, and is configured so as to be able to supply the raw material gas 80 supplied from the gas supply unit to the electrolytic solution 7 via the through holes 6.

Accordingly, electrolysis can be continuously carried out and the concentration of the raw material can be maintained at a constant level so that electrolysis can be carried out with good efficiency.

Furthermore, as shown in FIG. 15, when the electrolyzer is configured to supply the raw material gas 80 directly to the electrolytic solution 7 from the gas flow channel inlet 1 in the electrolytic bath 107, only the desired generated gases can be obtained from the anode 5*a* and/or cathode 5*b* without mixing the raw material gas therein as compared to the configuration of FIG. 14.

(Fifth Embodiment)

The electrolyzer according to the fifth embodiment will be illustrated below with reference to FIG. 16.

Figure 16:
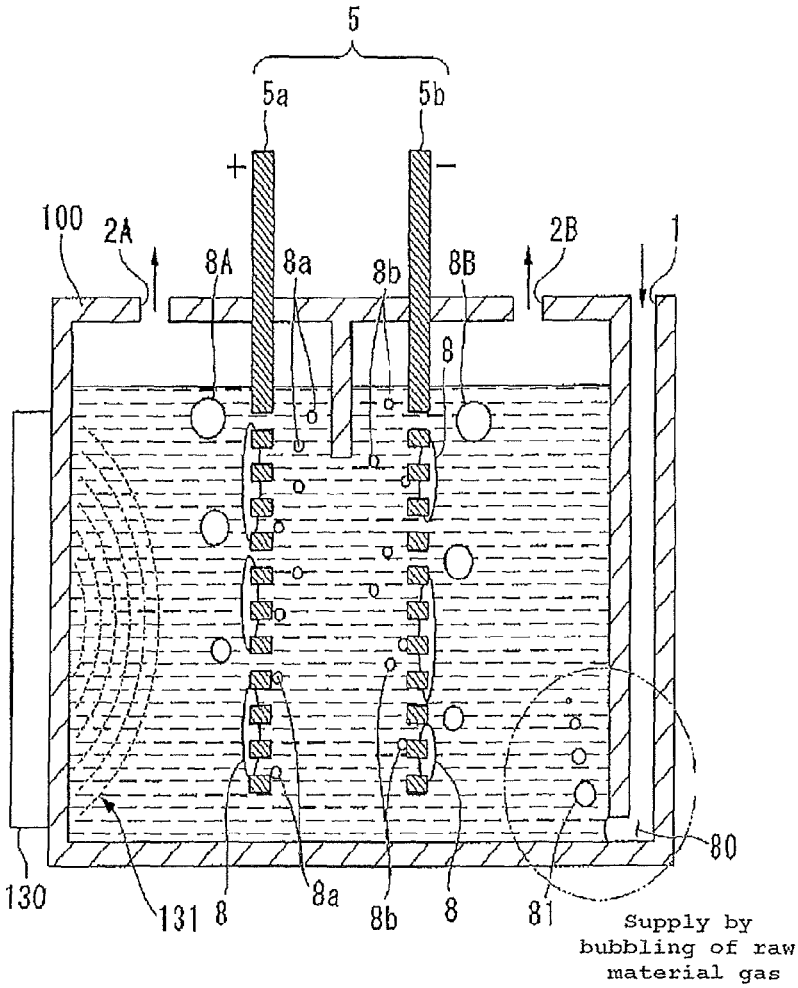
FIG. 16 is a schematic configuration view of an electrolyzer equipped with an ultrasonic wave generating device according to present embodiment.

FIG. 16 is a schematic configuration view of an electrolyzer, in the electrolyzer of FIG. 1, provided with an ultrasonic wave generation means (ultrasonic element 130) for applying an ultrasonic wave 131 to the anode 5*a*. As shown in FIG. 16, the electrolyzer is provided with the ultrasonic element 130 arranged at a side wall of the electrolytic bath 100. Incidentally, the electrolyzer can also be configured so as to apply the ultrasonic wave to the cathode 5*b*.

Hereinafter, effects of the electrolyzer according to present embodiment will be illustrated.

Since the ultrasonic element 130 for applying an ultrasonic wave to the anode 5*a* is arranged, the oscillation of the ultrasonic wave 131 generated from the ultrasonic element 130 is imparted to the anode 5*a* so that bubbles 8*a* are easily peeled off from the gas generating surface α of this anode 5*a*. Accordingly, bubbles 8*a* on the surface of the gas generating surface α can be quickly removed, and attachment of bubbles to the electrode surface and accordingly generation of an insulating compound are suppressed. Therefore, the current density per unit area of the electrode becomes uniform over a long period of time and the desired gases can be obtained with efficiency by electrolysis. Such an effect is effective when the electrode 5 is vertically immersed in the electrolytic solution 7.

(Sixth Embodiment)

When the gas generated on the gas generating surface α of the anode prevents electrolysis of the electrolytic solution 7, the electrolyzer according to the sixth embodiment uses an electrode in a gas permeable structure equipped with the through holes 6 on the anode. This electrolyzer (electrolytic cell) will be described with reference to FIGS. 22 to 26. Incidentally, in present embodiment, using molten salt containing hydrogen fluoride as the electrolytic solution, a fluorine gas generated from the anode and a hydrogen gas generated from the cathode are exemplified herein.

FIGS. 22 to 26 illustrate an electrolyzer using an electrode equipped with a plurality of through holes in the thickness direction of an electric conductor in a film shape or in a plate shape as an anode.

Figure 22:
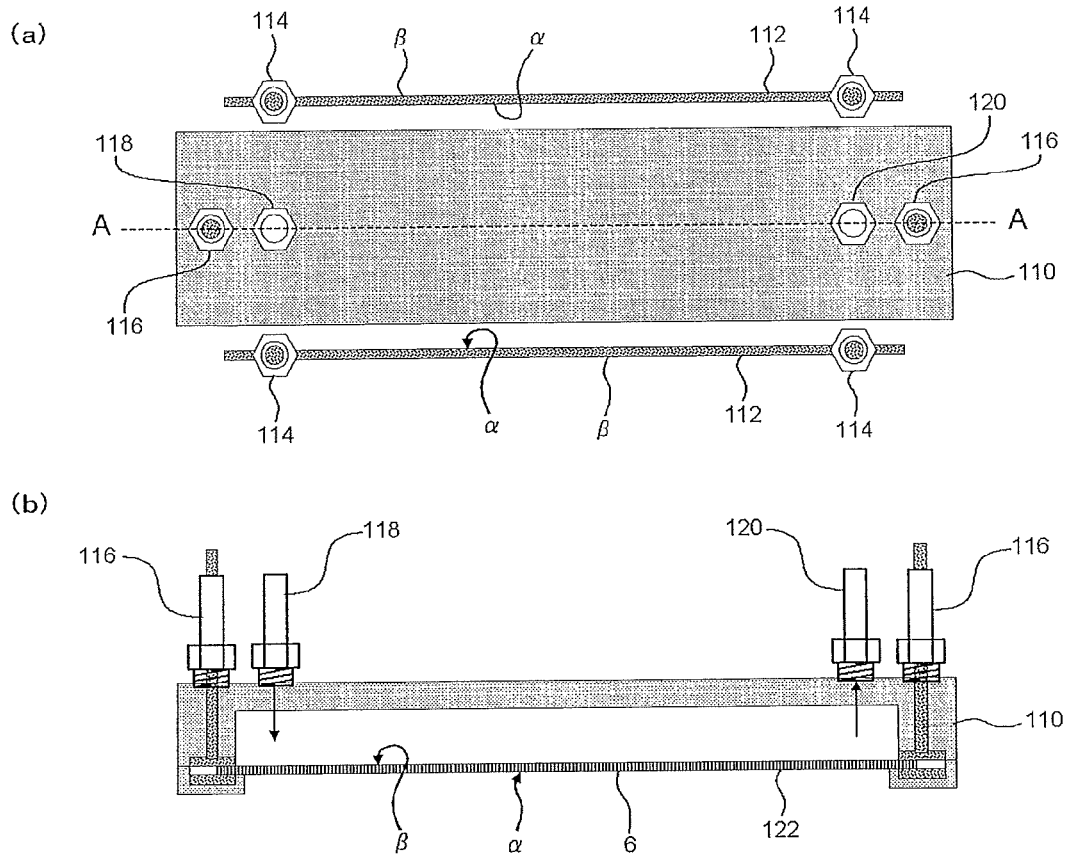
FIG. 22(*a*) is a top view and FIG. 22(*b*) is an A-A line sectional view of an electrolytic cell according to present embodiment.

FIG. 22 is a schematic configuration view of the electrolyzer arranged such that the gas generating surface α of an anode 122 is brought into contact with the liquid surface of the electrolytic solution. Herein, illustration of the electrolytic bath and the electrolytic solution is omitted.

Figure 23:
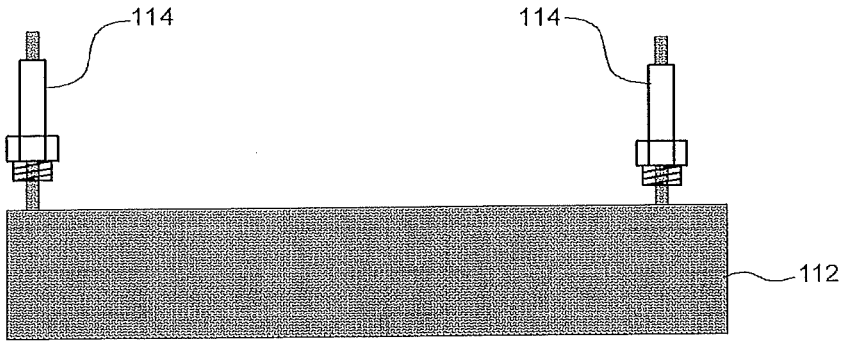
FIG. 23 is a side view of a cathode electrode of the electrolytic cell according to present embodiment.

FIG. 22(*a*) is a schematic top view of the electrolyzer, while FIG. 22(*b*) is an A-A sectional view of FIG. 22(*a*). FIG. 23 is a top plan view of a cathode 112.

As shown in FIGS. 22(*a*) and 22(*b*), a gas storage unit 110 covers the gas releasing surface β of the anode 122. The anode 122 is electrically connected with the cathode 112 via connecting portions 116, 116, and is configured such that a voltage can be applied between these electrodes. Furthermore, an inert gas inlet port 118 and a gas discharge port 120 are arranged on an upper surface of the gas storage unit 12. Accordingly, the gas generated at the anode 122 can be recovered.

Two cathodes 112, 112 are arranged on both sides of the gas storage unit 110. The anode 122 is electrically connected with the anode 122 via connecting portions 114, 114, and is configured such that a voltage can be applied between these electrodes (FIG. 23).

In the electrolyzer illustrated in FIGS. 22 and 23, the gas generated on the gas generating surface α of the anode 122 moves to the inside of the gas storage unit 110 via the through holes 6. Then, an inert gas is introduced into the gas storage unit 110 from the inert gas inlet port 118, and the desired gas is recovered from the gas discharge port 120 along with the inert gas.

On the other hand, as shown in FIG. 22(*a*), the two cathodes 112, 112 are arranged on both sides of the anode 122 and arranged vertically to the liquid surface of the electrolytic solution. The cathode 112 does not have the through holes 6. The gas generated at the cathode 112 is grown in the form of bubbles on the gas generating surface α. Then, when bubbles become a predetermined size, bubbles float up from the gas generating surface α and are recovered.

Figure 24:
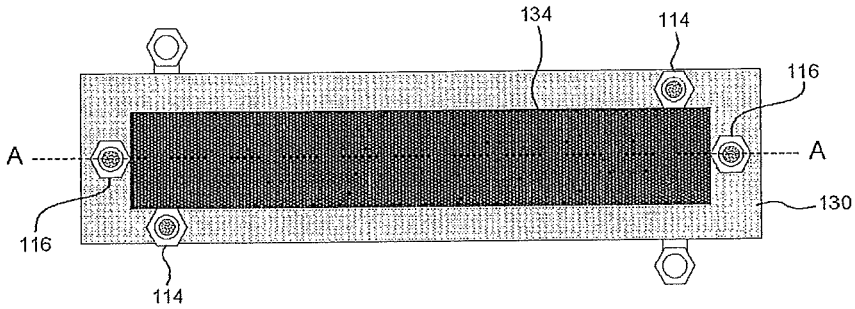
FIG. 24(*a*) is a top view and FIG. 24(*b*) is an A-A line sectional view of an electrolytic cell according to present embodiment.
Figure 24:
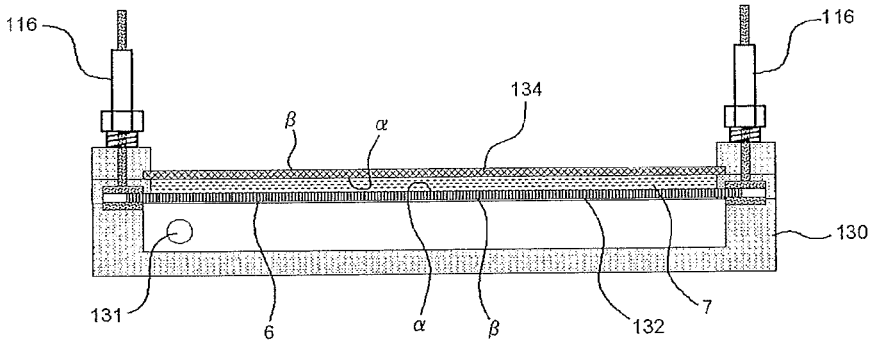

FIG. 24 is a schematic configuration view of an electrolyzer in which an anode 132 and a cathode 134 are oppositely disposed to each other and arranged in parallel, and the electrolytic solution is filled between these electrodes which are horizontally arranged.

FIG. 24(*a*) is a schematic top view of the electrolyzer, while FIG. 24(*b*) is an A-A sectional view of FIG. 24(*a*).

As shown in FIG. 24(*b*), the anode 132 and the cathode 134 are oppositely disposed to each other and arranged in parallel, and the electrolytic solution 7 is filled between these electrodes which are horizontally arranged. The anode 132 is positioned below the cathode 134. A gas storage unit 12 covers the gas releasing surface β of the anode 132. The gas storage unit 130 is provided with an inert gas inlet port 138, and is configured such that the desired gases can be recovered from a gas discharge port 139.

In the electrolyzer, the gas generated on the gas generating surface α of the anode 132 moves to the inside of the gas storage unit 12 placed at the lower part from the through holes 6 by the surface tension. Then, the inert gas is introduced into the gas storage unit 12 from the inert gas inlet port 131, while the desired gas is recovered from the gas discharge port (not illustrated) along with the inert gas.

On the other hand, the cathode 134 is configured such that the gas generating surface α is brought into contact with the electrolytic solution and the gas generated on the gas generating surface α is passed upward via the through holes 6. The gas storage unit (not illustrated) is also arranged on an upper surface of the cathode 134, and the gas generated at the cathode 134 can be recovered. Since the gas generated at the cathode 134 is passed upward via the through holes 6 by buoyancy, a structure such as a nickel mesh can also be used.

Figure 25:
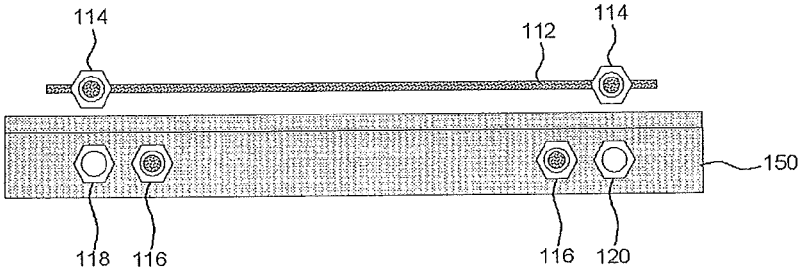
FIG. 25(*a*) is a top view of an electrolytic cell and FIG. 25(*b*) is a side view of an anode electrode according to present embodiment.
Figure 25:
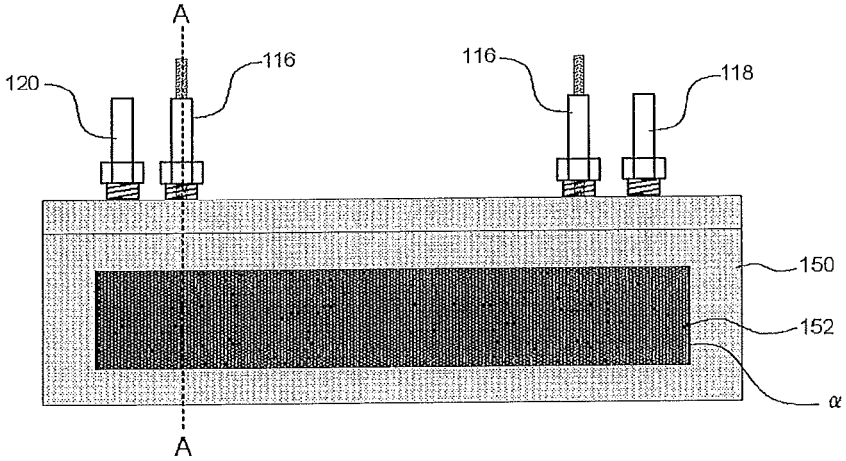
Figure 26:
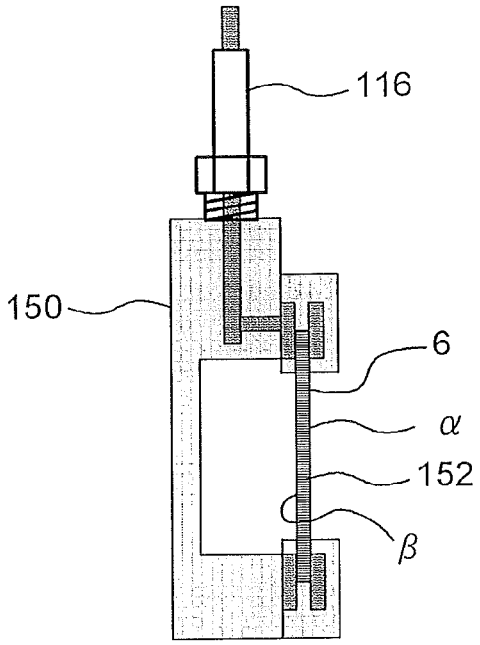
FIG. 26 is an A-A line sectional view of a cathode electrode in FIG. 25(*b*).

FIG. 25 is a schematic configuration view of an electrolyzer in which a gas storage unit covers only a gas releasing surface β of an anode 152. FIG. 25(*a*) is a schematic top view of the electrolyzer, while FIG. 25(*b*) is a top plan view of the anode 152 illustrated in FIG. 25(*a*). FIG. 26 is an A-A sectional view of the anode 152 illustrated in FIG. 25(*b*). Incidentally, illustration of the electrolytic bath and the electrolytic solution is omitted.

As shown in FIG. 25, the anode 152 and the cathode 112 are oppositely disposed to each other and arranged in parallel, and both of these electrodes are arranged perpendicular to the liquid surface of the electrolytic solution. As shown in FIG. 26, a gas storage unit 150 covers the gas releasing surface β of the anode 152. The gas storage unit 150 is provided with the inert gas inlet port 118, and is configured such that the desired gas can be recovered from the gas discharge port 120.

In the electrolyzer, the gas generated on the gas generating surface α of the anode 152 moves to the inside of a gas storage unit 150 from the through holes 6 by the surface tension. Then, an inert gas is introduced into the gas storage unit 150 from the inert gas inlet port 118, and the desired gas is recovered from the gas discharge port 120 along with the inert gas.

On the other hand, the gas generated at the cathode 112 is grown in the form of bubbles on the gas generating surface α. Then, when bubbles become a predetermined size, bubbles float up from the gas generating surface α and are recovered.

Furthermore, in present embodiment, an electrode in a structure equipped with the through holes 6 at the anode in use is exemplified. However, when the gas generated at the cathode prevents electrolysis, an electrode in a structure equipped with the through holes 6 at the cathode can also be used.

Hereinafter, effects of the electrolyzer according to present embodiment will be illustrated.

In the electrolyzer of present embodiment, only an electrode (anode) which generates a gas preventing electrolysis of the electrolytic solution 7 is used as an electrode in a gas permeable structure having the through holes 6. Accordingly, the degree of freedom in the design of the other electrode (cathode) is improved and the degree of freedom in the design of the electrolyzer is improved.

EXAMPLES

Experiment 1

The experiment results will be described below using an electrolytic cell experiment device (hereinafter referred to as this experiment device) with reference to FIGS. 17 to 19.

Figure 17:
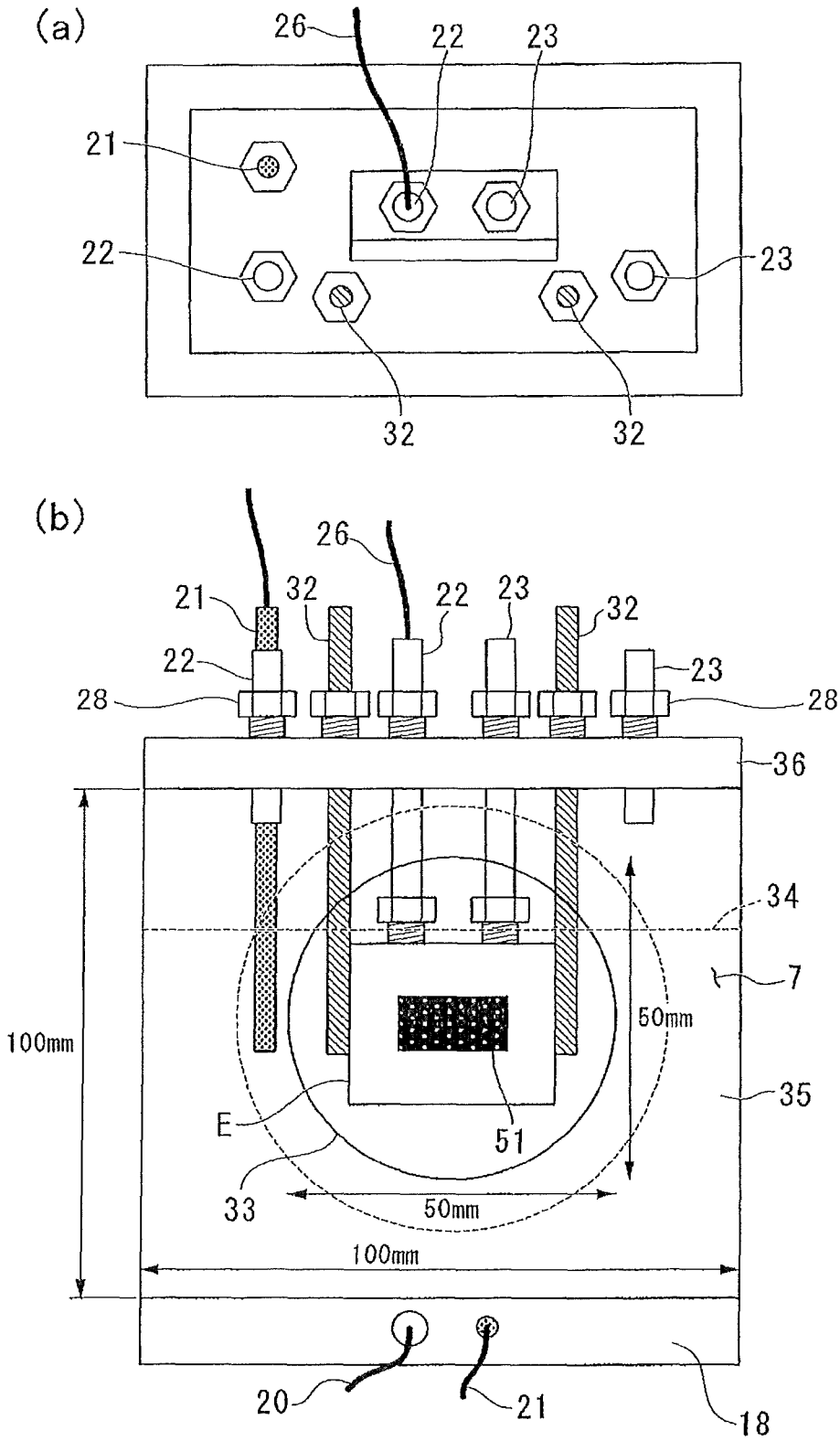
FIG. 17(*a*) is a top plan view and FIG. 17(*b*) is an elevational view of an electrolytic cell experiment device according to present embodiment.

FIG. 17(*a*) is a top view, while FIG. 17(*b*) is an elevational view of this experiment device.

The electrolytic cell experiment device illustrated in FIGS. 17(*a*) and 17(*b*) is a device in which an electrolytic cell E is built into the center of a molten salt bath 35 for carrying out the electrolysis experiment. The inside of the molten salt bath 35 is transilluminated for the sake of convenience of illustration.

A plurality of Teflon (registered trademark) tubes 22, 23 including a reserve are vertically fixed by Teflon (registered trademark) joints 28 to a canopy 36 for covering the upper part of the molten salt bath 35.

As shown in FIG. 17(*b*), a rod electrode 32 is partly immersed in the electrolytic solution 7 and its upper part is outside the molten salt bath 35. The electrode 32 is connected with a negative electrode of a DC power source through a conductor (not shown). Furthermore, in the center of the molten salt bath 35, the electrolytic cell E is suspended from the canopy 36 and immersed in the electrolytic solution 7. Hereinafter, the electrolytic cell E will be described with reference to FIG. 18.

Figure 18:
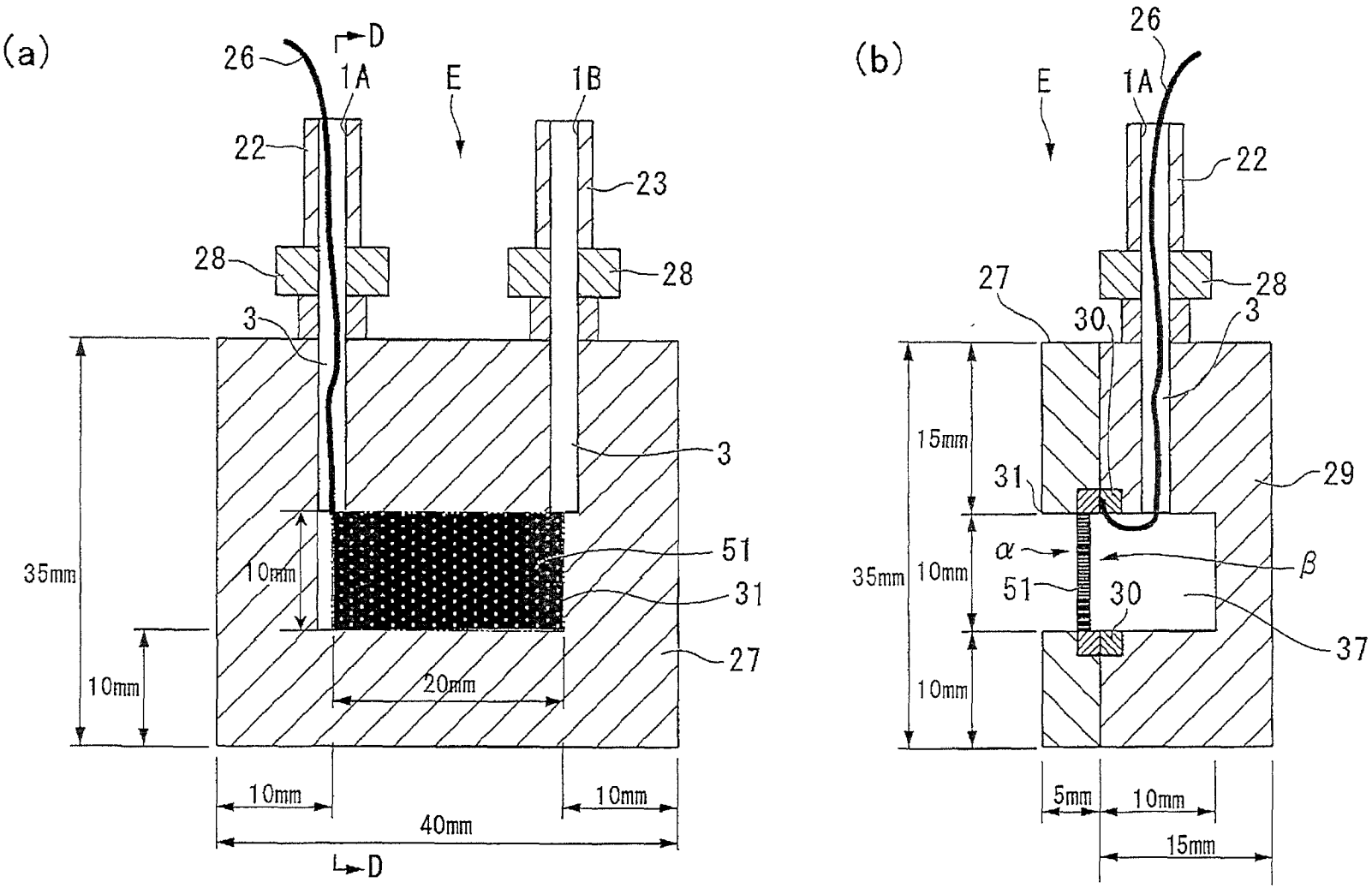
FIG. 18(*a*) is an elevational view and FIG. 18(*b*) is its D-D sectional view of an electrolytic cell in this experiment device.

FIG. 18(*a*) is a sectional view of the electrolytic cell E in this experiment device, while FIG. 18(*b*) is a D-D sectional view of FIG. 18(*a*). As shown in FIGS. 18(*a*) and 18(*b*), the electrolytic cell E is provided with an electrode 51 arranged at the front center of an electrolytic cell body 29 made of an insulating material. The electrode 51 is fixed by an electrode pressing plate 27. The gas generating surface α of the electrode 51 can be brought into contact with the electrolytic solution 7 by the electrode pressing plate 27. The electrode 51 is connected with a positive electrode of a DC power source through a metal wire 26 (nickel wire) for electrical communication.

The electrolytic cell body 29 is composed of a PTFE plate, and has a shape of 35 mm×40 mm×15 mmt. Furthermore, in the center thereof, a recessed portion 37 having a depth of 10 mm is provided, and a window 31 is formed. The gas releasing surface β of the electrode 51 is exposed in the inside of the recessed portion 37. Further, in the electrolytic cell body 29, the gas flow channel 3 is arranged in the inside of Teflon (registered trademark) tubes 22, 23, and a gas can be introduced into a space 34 in the recessed portion from the outside and discharged.

A recessed portion is formed in the front edge of the recessed portion 37, and a metal frame 30 for electrical communication is fitted in the recessed portion. On the other hand, the electrode 51 is fitted in the recessed portion 37 of the electrode pressing plate 27. The electrode pressing plate 27 is connected with the electrolytic cell body 29, whereby the electrode 51 is fixed to the electrolytic cell E.

A nitrogen gas is introduced into the space 34 inside the recessed portion by the Teflon (registered trademark) tube 22 connected with the electrolytic cell E, and released from the Teflon (registered trademark tube) 23 which is a discharge tube. The gas flowing out from the Teflon (registered trademark tube) 23 can be collected for the analysis.

The negative electrode 32 is composed of two nickel rods having a diameter of 3 mm. The electrode 32 is placed near a side of the electrode 51 while avoiding the front thereof so as not to block the field of vision for observing the electrode 51, and two electrodes are arranged at the left-right symmetric positions in order to make the distance between positive and negative electrodes to be equal to each other.

A molten salt liquid surface level 33 is maintained at a height in which the electrode 51 of the electrolytic cell E is immersed in the electrolytic solution 7. Furthermore, in a state that the liquid surface of the electrolytic solution 7 remains 4 cm or more above the lowest part of the electrode 51, it is essentially required that the electrolytic solution 7 be not soaked into, permeated through and leaked out to the recessed portion 37 via the through holes.

The bottom of the molten salt bath 35 is configured so as to be placed by sandwiching a Teflon (registered trademark) sheet (t=0.2 mm) on a heater block 18 made of copper. The heater block 18 is provided with a rod heater 20 and a thermocouple 21 for properly heating the electrolytic solution 7 from the bottom of the molten salt bath 35. The temperature of the electrolytic solution 7 can be maintained at a prescribed temperature by feeding temperature information detected by the thermocouple 21 to a thermostat (not shown) or the like.

In this Experiment, in order to obtain an $F_2$ gas, the electrolytic solution containing HF is electrolyzed. In general, anhydrous HF exhibits high electrical resistance and is hard to perform electrolysis. When, for example, KF is reacted with HF to prepare the electrolytic solution 7 of HF·nHF, electrical resistance of the electrolytic solution 7 is low so that HF in the electrolytic solution 7 can be electrolyzed.

$$2HF \rightarrow H_2 + F_2$$

In this reaction, KF is not consumed, but only HF as a raw material is consumed. Accordingly, there is a need to supply the HF gas into the electrolytic solution 7 depending on the amount of the generated $F_2$ gas. Then, the HF gas is bubbled in the electrolytic solution 7 in the electrolytic bath 35 for supplying HF to the electrolytic solution 7. The electrolytic solution 7 is heated to its melting point or more, a convection current is generated in the inside of the electrolytic bath, and the electrolytic solution 7 is further stirred along with an effect of a convection current generated by bubbling. Accordingly, HF supplied to the electrolytic solution 7 is almost uniformly diffused into the electrolytic solution 7.

Figure 19:
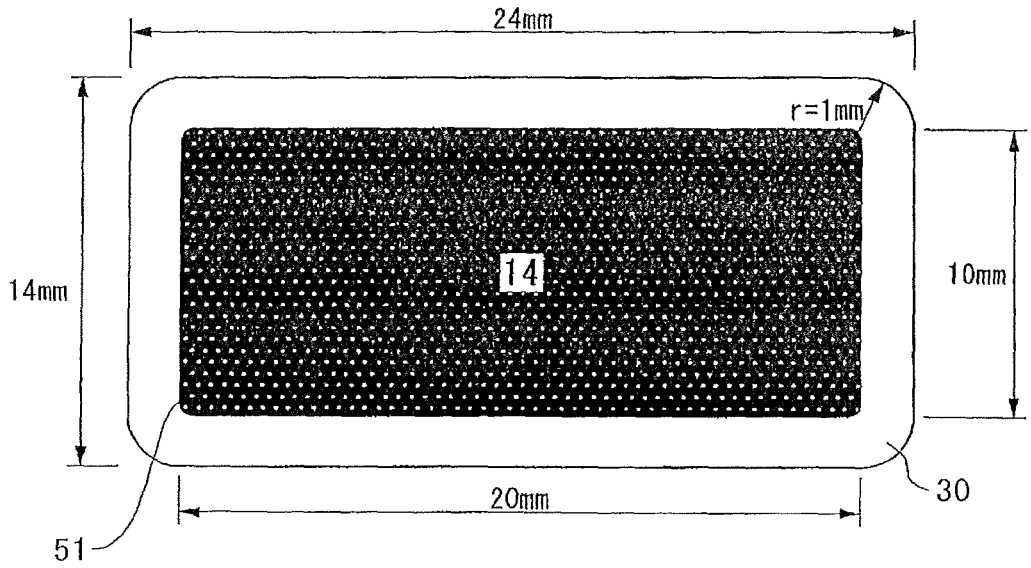
FIG. 19(*a*) is an elevational view of an electrode and FIG. 19(*b*) is an elevational view of a metal frame for electrical communication for an electrolytic cell in this experiment device.
Figure 19:
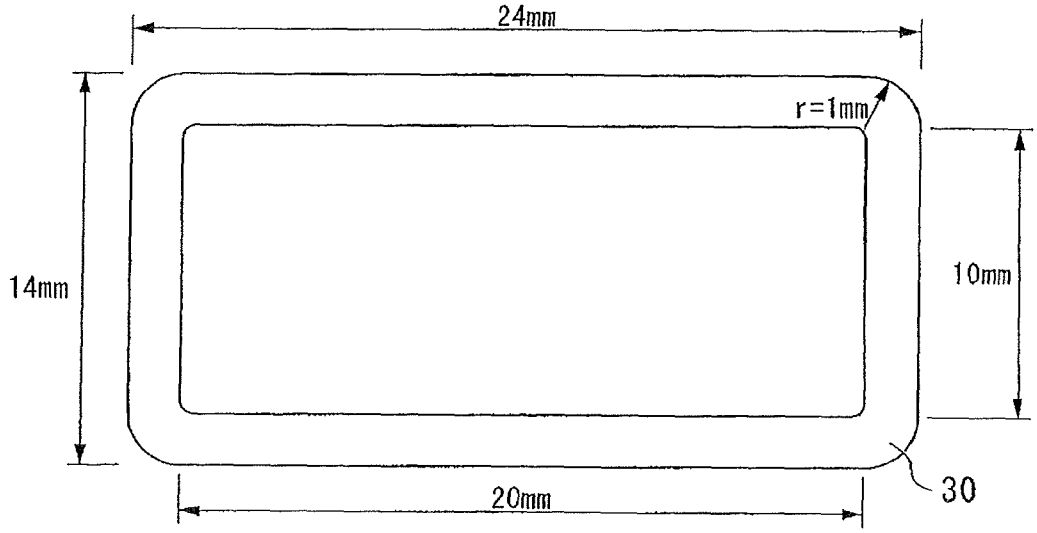

FIG. 19(*a*) is an elevational view of the electrode 51 of the electrolytic cell E in this experiment device, while FIG. 19(*b*) is an elevational view of the metal frame 30 for electrical communication. The electrode 51 shown in FIG. 19(*a*) is prepared by making a carbon plate (G348 1 mmt, a product of Tokai Carbon Co., Ltd.) at a size of 24 mm×14 mm (r=1 mm), and then forming recessed portions of a depth of merely 0.6 mm on a counterbore surface 14, and arranging through holes in the thickness direction of the carbon plate on the recessed portions of the counterbore surface 14.

As shown also in FIG. 2, the through holes 6 having a diameter of 100 μm are prepared in a 60° zig-zag form at a pitch of 150 μm using a drill (carbide solid micro drill ADR-0.1). Furthermore, the effective electrode surface area of a machined surface of the through holes 6 in contact with the electrolytic solution 7 is set to 10 mm×20 mm.

As shown in FIG. 18(*b*), the metal frame 30 for electrical communication illustrated in FIG. 19(*b*) is a metal frame for electrical communication so as to support the electrode 51 and at the same time apply a positive voltage. The metal frame 30 for electrical communication is a nickel frame in which a window of 20 mm×10 mm (r=0.5 mm) is formed on the nickel plate having an outer size of 24 mm×14 mm×2 mmt (r=1 mm) by cutting process.

The metal frame 30 for electrical communication is connected to the positive power source through the nickel wire having a diameter of 0.5 mm, that is, the metal wire 26 for electrical communication. The Teflon (registered trademark) joints 28 are arranged at the upper part of the electrolytic cell body 29, and Teflon (registered trademark) tubes 22, 23 are fixed to the Teflon (registered trademark) joints 28. The electrolytic cell E and the electrolytic cell experiment device are configured such that the metal wire 26 for electrical communication can be passed through the inside of the Teflon (registered trademark) tube 22 and brought into contact with the DC power source outside the electrolytic cell E.

In the electrolytic cell experiment device, a DC voltage of 7.0 V was applied between the electrode 51 serving as an anode and the rod-shaped electrode 32 serving as a cathode for carrying out constant voltage electrolysis. Nitrogen was supplied from the Teflon (registered trademark) tube 22 which is each gas flow channel inlet (inlet ports) at a flow rate of 10 mL/min. In this state, the gas generated from the electrode 51 was discharged into the space inside the recessed portion 37 via the through holes 6, and discharged from the Teflon (registered trademark) tube 23 which is each gas flow channel outlet (outlet port) along with the nitrogen gas. Incidentally, it was observed that bubbles rising to the liquid surface of the electrolytic solution 7 from the surface of the electrode 51 were not present.

Figure 20:
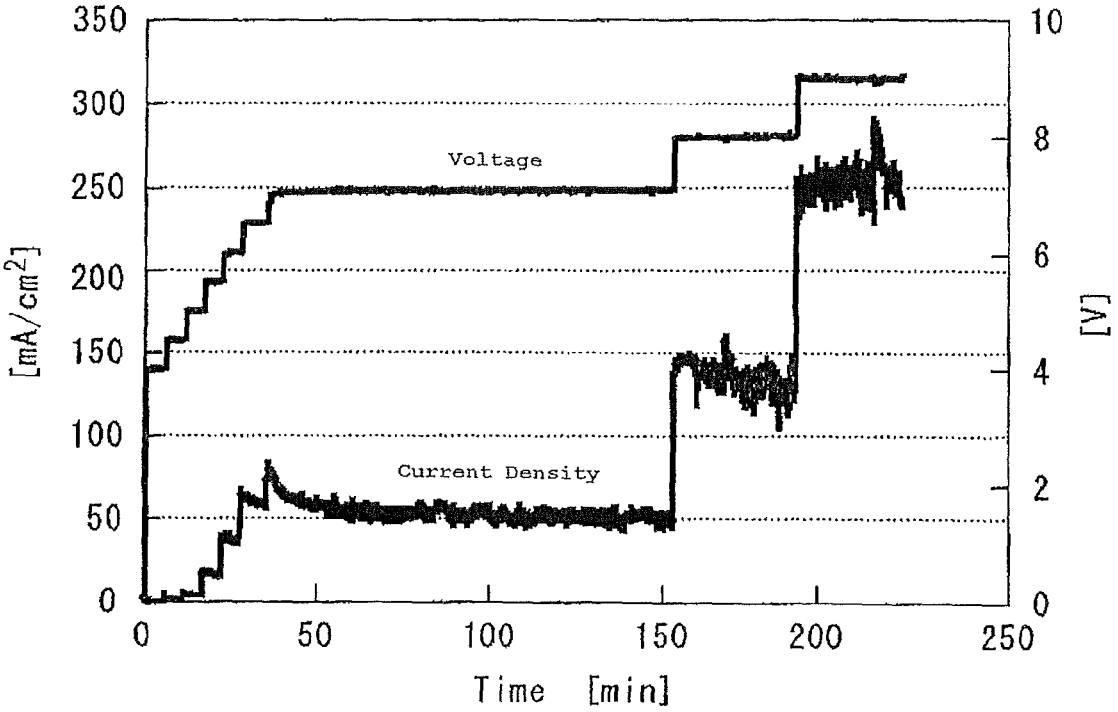
FIG. 20 is a graph showing the relationship between the time required for electrolysis and the current density in Experiment 1.

The gas released from the gas flow channel outlet 23 (outlet port) was collected in a Tedlar bag, and a fluorine gas detector tube (Gas detector tube No. 17, a product of Gastec Corporation) was used for the measurement. As a result, an indicator of the detector tube was bleached to white so that it was confirmed that a fluorine gas was generated. As the amount of change with the time of current density at this time, an average current density in a stable state was about 50 mA/cm$^2$. When the voltage was set to 8V, an average current density was about 120 mA/cm$^2$, while when the voltage was set to 9V, an average current density was about 250 mA/cm$^2$. FIG. 20 illustrates a graph showing the above results.

Experiment 2

Electrolysis was carried out in the same manner as in Experiment 1, except that the pitch of the through hole 6 arranged on the electrode 51 was changed to 1 mm. The liquid surface of the electrolytic solution 7 was filled up to the position of 4 cm or more above the lowest part of the electrode 51, but it was confirmed that the electrolytic solution 7 was not leaked to the gas flow channel 3 via the through holes 6 in the same manner as in Experiment 1. Furthermore, when the voltage was set to 7V, an average current density in a stable state was about 80 mA/cm$^2$, while when the voltage was set to 8V, an average current density was about 150 mA/cm$^2$. When the voltage was set to 9V, an average current density was about 200 mA/cm$^2$.

Experiment 3

Figure 21:
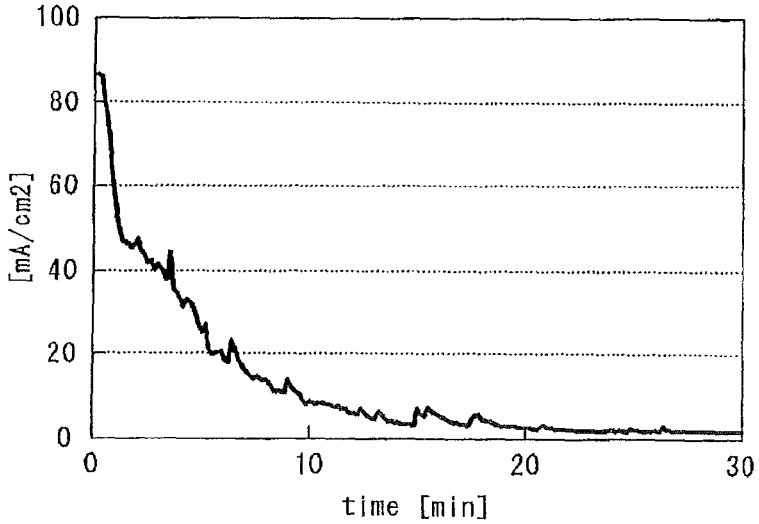
FIG. 21 is a graph showing the relationship between the time required for electrolysis and the current density in Experiment 3.

Electrolysis was carried out in the same manner as in Experiment 1, except that the through holes 6 were not formed on the electrode 51. Immediately after the voltage of 7V was applied, a current was flowed at a current density of about 90 mA/cm$^2$, whereas the current was gradually decreased and rarely flowed after about 20 minutes. FIG. 21 illustrates a graph showing the above results.

Furthermore, in all of the aforementioned Experiments, hydrogen fluoride was decomposed into fluorine and hydrogen by the electrolysis reaction of hydrogen fluoride which could be respectively recovered. Further, in this experiment, as a substance for the electrolysis reaction of hydrogen fluoride, the electrolytic solution 7 containing hydrogen fluoride was exemplified, but the electrolytic solution 7 may be other substances.

The following effects were achieved by the electrolyzer and its electrodes according to the present invention.

1) Deterioration of the electrode is suppressed by suppressing attachment of bubbles to the surface of the electrode.

2) The current density per unit area of the electrode becomes uniform by suppressing attachment of bubbles to the surface of the electrode.

3) Desired gases are generated by making the current density uniform and carrying out electrolysis effectively over a long period of time.

4) Deterioration of the electrode is prevented by eliminating deviation of the concentration distribution of the raw material component on the electrode surface and making it uniform.

5) The supply efficiency of the electrode structure, the electrolytic bath and the raw material gas, and the degree of freedom in design are generally improved.

Meanwhile, the present invention can also be configured as follows.

(1) An electrolyzer using an electrode for at least any one of an anode or a cathode which is composed of a conductor having a gas permeable structure allowing only a gas to pass by performing any one or both of a surface treatment which causes a surface desired to be wetted by the electrolytic solution to be lyophilic or a surface treatment which causes a reverse surface desired not to be wetted by the electrolytic solution to be lyophobic for an electric conductor having a plurality of through holes leading from an arbitrary surface to a reverse surface.

(2) The electrolyzer as set forth in (1), wherein said electrode having through holes has any of a mesh structure, a porous structure, a porous film structure or a structure with a plurality of through holes.

According to such a configuration, when a surface treatment which causes the electrode surface facing to a different electrode and effective for electrolysis which is the facing electrode surface (or front face of an electrode) to be lyophilic is carried out, bubbles generated by electrolysis are quickly removed without surrounding the opposing electrode surface.

On the other hand, in the gas permeable electrode, when a surface treatment which causes the reverse electrode surface which is the back surface of the facing electrode surface is carried out, bubbles generated by electrolysis are easily passed from the facing electrode surface to the reverse electrode surface and bubbles on the facing electrode surface can be quickly removed.

(3) The electrolyzer as set forth in (1) or (2), wherein positive and negative DC voltages are applied to electrodes located at both ends of a row of divided electrodes in a strip shape and arranged by spacing at almost equal intervals with one another.

According to the electrolyzer having such a configuration, positive and negative DC voltages are applied from electrodes located at both ends of its row of electrodes to a row of divided electrodes in a strip shape and arranged by spacing at almost equal intervals with one another.

Then, an effect of activities substantially equivalent to direct connection without connecting using a wire or the like between a row of divided electrodes in the electrolytic solution of the same electrolytic bath.

Then, when electrolysis is carried out using the aforementioned electrodes, the efficiency in removing bubbles is improved because bubbles are removed from the aforementioned gaps.

(4) The electrolyzer as set forth in (1) or (2), wherein the electrolyzer is provided with a ventilation duct capable of capturing bubbles by covering the reverse surface of the aforementioned electrode for ventilation.

According to such a configuration, bubbles collected on the reverse electrode surface are captured and collected at a ventilation duct covering its reverse electrode surface without exception so that the efficiency in removing bubbles from the electrode surface is improved.

(5) The electrolyzer as set forth in any one of (1) to (4), wherein electrodes are brought into contact with the aforementioned electrolytic solution and horizontally arranged.

According to such a configuration, when electrodes brought into contact with the aforementioned electrolytic solution and horizontally arranged are used for carrying out electrolysis, bubbles generated at the lower side in contact with the liquid are passed to the upper side and easily removed so that the efficiency in removing bubbles is improved.

Moreover, the electrolytic solution at the lower side of this electrode is not passed nor moves to the upper side. Incidentally, when electrodes are brought into contact with the electrolytic solution and horizontally arranged, the height may be any height up to the liquid surface from the bottom of the electrolytic bath with no preference so that the degree of freedom in the design is secured.

(6) The electrolyzer as set forth in (4), wherein the aforementioned electrodes are brought into contact with the liquid surface of the electrolytic solution and have a drop-lid configuration to cover the electrolytic solution.

According to such a configuration, when electrodes having a drop-lid configuration to cover the electrolytic solution are used for electrolysis, bubbles generated at the lower side in contact with the liquid surface are passed to the upper side and easily removed so that the efficiency in removing bubbles is improved. Moreover, the electrolytic solution is not leaked from the lower to the upper direction of the electrode having a drop-lid configuration (7) The electrolyzer as set forth in any one of (1) to (4), wherein the aforementioned electrodes are immersed in the electrolytic solution and arranged in the vertical direction.

According to such a configuration, as for the electrolytic solution or the electrode provided with the oscillation of an ultrasonic wave, removal of bubbles from the electrode surface is accelerated by an ultrasonic wave generation means.

(8) The electrolyzer as set forth in any one of (4) to (7), wherein when any one of two kinds of gases respectively generated from positive and negative electrodes is inferior gas having a low value, the raw material gas is supplied to the electrolytic solution from the ventilation duct attached to the electrode generating the inferior gas.

According to such a configuration, when any one of two kinds of gases obtained by electrolysis is highly needed and the other gas is needless, the raw material gas is supplied from the ventilation duct attached to the electrode generating the gas having a lower value, whereby the raw material gas is dissolved in the electrolytic solution through the gas permeable electrode for passing gases. Then, the concentration of the raw material in the electrolytic solution becomes higher so that the efficiency in electrolysis can be improved.

(9) The electrolyzer as set forth in any one of (4) to (7), wherein the aforementioned electrodes are composed of a pair of electrodes configured by sandwiching the ventilation duct and a pair of the electrodes are arranged alternately.

(10) The electrolyzer as set forth in any one of (1) to (9), wherein the electrolyzer is provided with an ultrasonic wave generation means for imparting the oscillation of an ultrasonic wave to the electrolytic solution or the electrodes.

(11) The electrolyzer as set forth in any one of (1) to (10) using molten salt containing hydrogen fluoride as the electrolytic solution, wherein a fluorine gas is generated by using the electrode as an anode.

According to such a configuration, according to the electrolyzer using molten salt containing hydrogen fluoride as the electrolytic solution, a fluorine gas can be generated from the anode, while a hydrogen gas can be generated from the cathode.

(12) An electrode used for the electrolyzer as set forth in any one of (1) to (11). The electrode configured as such is freely replaceable as a repair part so that it can also be sold as a single item.

(13) An electrolysis method in which an electrode is adopted as at least any one of an anode or a cathode, the electrode is composed of a conductor having a gas permeable structure allowing only a gas to pass by performing a surface treatment which causes a side in contact with the electrolytic solution to be lyophilic for the electrolytic solution and at the same time a surface treatment which causes a reverse surface not in contact with the electrolytic solution to be lyophobic, and the gas generated by electrolysis using the electrolyzer adopting a ventilation duct capable of supplementing bubbles covering the reverse surface of the electrode and capable of ventilating is collected.

The invention claimed is:

1. An electrolyzer comprising an anode and a cathode in contact with an electrolytic solution, wherein at least one of said anode and said cathode is composed of an electric conductor having a gas permeable structure comprising a gas generating surface at which a gas is generated by electrolysis of said electrolytic solution, a plurality of through holes leading from said gas generating surface to a different surface and allowing said gas generated at the gas generating surface to selectively pass therethrough, and a gas releasing surface which is said different surface for releasing said gas supplied from said gas generating surface via said through holes, and at least one of a surface treatment which causes said gas generating surface to be lyophilic for said electrolytic solution and a surface treatment which causes said gas releasing surface to be lyophobic for said electrolytic solution is performed, and said through holes have a radius so that the pressure of said electrolytic solution is not more than Young-Laplace pressure ΔP based on the following formula;

$$\Delta P = -2\gamma \cos\theta / r$$

wherein γ [N/m] is the surface tension of the electrolytic solution, θ [deg] is the contact angle between the at least one of said anode and said cathode and the electrolytic solution and r[m] is the radius of said through holes of said at least one of said anode and said cathode; and a gas storage unit for covering said gas releasing surface of the at least one of said anode and said cathode, and receiving said gas released from said gas releasing surface;

wherein said electrolytic solution is molten salt containing hydrogen fluoride and a fluorine gas is generated at said anode.

2. The electrolyzer as set forth in claim 1, wherein a storage tank is filled with said electrolytic solution.

3. The electrolyzer as set forth claim 1, wherein said anode and said cathode are arranged in parallel and said respective gas generating surfaces are oppositely disposed to each other.

4. The electrolyzer as set forth in claim 1, wherein at least one of said anode and said cathode is immersed in the direction perpendicular to the liquid surface of said electrolytic solution.

5. The electrolyzer as set forth in claim 1, wherein at least two pairs of said anodes and said cathodes are provided, at least said gas releasing surfaces of said anodes or said gas releasing surfaces of said cathodes are oppositely disposed to each other, and said gas storage unit for covering any of a pair of said gas releasing surfaces facing to each other is provided.

6. The electrolyzer as set forth in claim 1, wherein said gas storage unit is provided with an inert gas supply unit, and is configured such that it can be ventilated by supplying the inert gas from said inert gas supply unit to the inside of said gas storage unit.

7. The electrolyzer as set forth in claim 1, wherein said gas storage unit of said anode or said cathode is provided with a raw material gas supply unit, and is configured such that the raw material gas supplied from said raw material gas supply unit can be supplied to said electrolytic solution via said through holes.

8. The electrolyzer as set forth in claim 1, wherein at least one of said anode and said cathode is horizontally arranged to the liquid surface of said electrolytic solution and only said gas generating surface is brought into contact with the liquid surface of said electrolytic solution.

9. The electrolyzer as set forth in claim 8, wherein at least one of said anode and said cathode horizontally arranged to the liquid surface of said electrolytic solution is configured so as to able to move vertically.

10. The electrolyzer as set forth in claim 2, wherein said storage tank is provided with a raw material gas supply unit and is configured such that the raw material gas can be supplied to said electrolytic solution from said raw material gas supply unit.

11. The electrolyzer as set forth in claim 1, wherein the electrolyzer is provided with an ultrasonic wave generation means for applying an ultrasonic wave to at least one of said anode or said cathode.

12. The electrolyzer as set forth in claim 1, wherein said electrode having a gas permeable structure is used for the electrode for generating the gas when the gas generated on said gas generating surface of said anode or said gas generating surface of said cathode prevents electrolysis of said electrolytic solution.

13. The electrolyzer as set forth in claim 1, wherein said surface treatment for imparting the lyophilic property is plasma treatment, ozone treatment or corona discharge treatment, and said surface treatment for imparting the lyophobic property is fluorine resin coating treatment, plasma treatment using a fluorine gas or fluorine gas treatment.

14. The electrolyzer as set forth in claim 1, wherein at least one of said anode and said cathode has a gas permeable structure selected from a mesh structure, a porous structure, a porous film structure, and a structure with said plurality of through holes arranged in the thickness direction of said electric conductor in a film shape or in a plate shape.

15. An electrolysis method using the electrolyzer as set forth in claim 1.

* * * * *